US005576161A

United States Patent [19]

Nishimura et al.

[11] Patent Number: 5,576,161

[45] Date of Patent: Nov. 19, 1996

[54] SILVER HALIDE LIGHT-SENSITIVE PHOTOGRAPHIC MATERIAL AND METHOD OF PROCESSING THEREOF

[75] Inventors: Motoi Nishimura; Hirokazu Sato; Hiroshi Kita, all of Tokyo, Japan

[73] Assignee: Konica Corporation, Tokyo, Japan

[21] Appl. No.: 505,901

[22] Filed: Jul. 24, 1995

[30] Foreign Application Priority Data

Aug. 12, 1994 [JP] Japan ..... 6-190647

[51] Int. Cl.[6] ..... G03C 1/10

[52] U.S. Cl. ..... 430/512; 430/510; 430/502; 430/931; 430/551; 430/600; 430/601; 430/602; 430/607; 430/558

[58] Field of Search ..... 430/502, 510, 430/512, 931, 551, 607, 558, 567, 600, 601, 602

[56] References Cited

U.S. PATENT DOCUMENTS

| | | | |
|---|---|---|---|
| 2,482,546 | 9/1949 | Kaszuba | 430/401 |
| 2,596,926 | 5/1952 | Gunther et al. | 430/372 |
| 2,610,122 | 9/1952 | John et al. | 430/436 |
| 3,128,182 | 4/1964 | Bard et al. | 430/379 |
| 3,128,183 | 4/1964 | Jones et al. | 430/602 |
| 3,253,919 | 5/1966 | Beavers et al. | 430/444 |
| 3,505,068 | 4/1970 | Beckett et al. | 430/138 |
| 3,532,501 | 10/1970 | Mackey et al. | 430/601 |
| 3,574,628 | 4/1971 | Jones | 430/567 |
| 3,582,346 | 6/1971 | Dersch | 430/602 |
| 3,655,394 | 4/1972 | Illingsworth | 430/567 |
| 3,813,247 | 5/1974 | Minsk et al. | 430/627 |
| 4,119,462 | 10/1978 | Hodes | 430/469 |
| 4,183,756 | 1/1980 | Locker | 430/569 |
| 4,225,666 | 9/1980 | Locker et al. | 430/569 |
| 4,230,796 | 10/1980 | Gunther et al. | 430/523 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,444,877 | 4/1984 | Koitabashi et al. | 430/567 |
| 4,774,181 | 9/1988 | Ravindran et al. | 430/359 |

FOREIGN PATENT DOCUMENTS

| | | |
|---|---|---|
| 63-11935 | 1/1988 | Japan . |
| 63-60446 | 3/1988 | Japan . |

*Primary Examiner*—Geraldine Letscher
*Attorney, Agent, or Firm*—Finnegan, Henderson, Farabow, Garrett & Dunner, L.L.P.

[57] ABSTRACT

A silver halide color photographic material improved in color forming properties and light fastness of color image is disclosed, comprising a support having thereon a light-sensitive silver halide emulsion layer and a nonlight-sensitive layer, wherein the nonlight-sensitive layer contains a UV absorbent and the silver halide emulsion layer contains a polyhydric alcohol.

5 Claims, No Drawings

SILVER HALIDE LIGHT-SENSITIVE PHOTOGRAPHIC MATERIAL AND METHOD OF PROCESSING THEREOF

INDUSTRIAL FIELD OF THE INVENTION

The present invention relates to a silver halide light-sensitive photographic material and a method of processing thereof. More specifically, the present invention relates to a silver halide light-sensitive photographic material having improved light fastness and color forming efficiency, with restrained physical deterioration of the surface of the light-sensitive photographic material, or sweating due to heat and moisture, and having excellent sharpness of a dye-image formed therein, and a method of processing it.

BACKGROUND OF THE INVENTION

In the silver halide light-sensitive color photographic material for direct visual appreciation, yellow dye-forming coupler, magenta dye-forming coupler and cyan dye-forming coupler are usually used as the color forming material with which a dye image is formed, and to these couplers some, basic properties such as dye-forming efficiency, storage stability of the dye, color reproduction and sharpness of the dye image produced therefrom are usually required.

As a method of improving fastness of a dye image against light, for example, Japanese Patent O.P.I. Publication No. 3-39956(1991) discloses a method of using anti-oxidants of phenol derivatives or amine derivatives. However, most attempts to improve light fastness, which had been made in the art were either a method of using an anti-oxidant or a method of contriving structures of the dye image-forming coupler itself, and few attempts have ever been reported in order to improve fastness of a dye image against light by the use of a high boiling solvent.

Japanese Patent O.P.I. Publication Nos. 63-11935(1988) and 63-60446(1988) disclose a technique of improving dispersion stability by the use of a polyhydric alcohol as a surface active agent. Moreover, Japanese Patent O.P.I. Publication Nos. 55-56867(1980), 49-66329(1974), 63-169639(1988), 1-260437(1989), 2-96743(1990) and 4-131839(1992) disclose polyhydric alcohol as examples of a nonionic surface active agent. In both cases, however, the polyhydric alcohol are used as a surface active agent and the effect thereof is also limited to properties of the surface active agent.

Further, Japanese Patent O.P.I. Publication No. 4-265975(1992) discloses a method of improving stability of a developing solution against pH fluctuation thereof, by incorporating a monohydric alcohol into a silver halide light-sensitive photographic material. However, it was found that the compounds disclosed in Japanese Patent O.P.I. Publication No. 4-265975(1992) have substantially no effects on the improvement of the storage stability of the dye image.

Further, Japanese Patent O.P.I. Publication No. 5-216189(1993) discloses a technique of improving fastness of the dye image against light and restricting a phenomenon that an oily ingredient by exudes onto the surface of a dye image by the use of an ultraviolet radiation absorbent (UV absorbent) which is in the form of liquid under the normal temperature. Still further, Japanese Patent O.P.I. Publication No. 5-173703(1993) discloses a method of improving light fastness of the dye image and restricting sweating by the use of an UV absorbent having a specific chemical structure, however, these methods relate to a technique of improving anti-sweating of the UV absorbent itself and there is no reference to the improvement of non-exuding property from a layer containing the UV absorbent, and to the fact that the UV absorbent disclosed in the reference has other optical efficacies than those mentioned above.

On the other hand, in recent years, light-sensitive materials are usually processed continuously in a processor installed in the laboratory and, in such processing of the light-sensitive materials, a rapid processing system, in which light-sensitive materials are processes and returned to customers within a short period of time, for example, within the same day and, most recently within a period of a several tens of minutes has become popular. Thus accessibility to rapider processing has become a strong demand. Under such technical background, Eastman Kodak Company has proposed a rapid processing system called "RA-4" for color photographic paper, however, it was found that considerable shortening of processing time often accompanies large amount of fluctuation in the image-forming stability and, especially, in the maximum density of an image during the process.

SUMMARY OF THE INVENTION

Accordingly, the first object of the present invention is to provide a silver halide light-sensitive photographic material which is capable of producing a dye image with reduced fading with light. The second object of the present invention is to provide a silver halide light-sensitive photographic material with reduced sweating (or bleeding-out) phenomenon during storage. The third object of the present invention is to provide a silver halide light-sensitive photographic material with excellent sharpness in the dye image produced therein.

The fourth object of the present invention is to provide a silver halide light-sensitive photographic material which is capable of producing a dye image having substantially no side-absorption and which, therefore, has excellent and improved color reproduction. The fifth object of the present invention is to provide a method of processing a silver halide light-sensitive photographic material which is susceptible to rapid processing without causing deterioration in the photographic property. The sixth object of the present invention is to provide a silver halide light-sensitive photographic material having excellent color forming efficiency.

The above-mentioned objects of the present invention were achieved by the following.

(1) In a silver halide light-sensitive photographic material comprising a support having thereon at least one silver halide light-sensitive layer and at least one non-light-sensitive layer said silver halide light-sensitive photographic material characterized in that said non-light-sensitive layer comprises a UV absorbent which is in the form of liquid at an ordinary temperature and that said silver halide light-sensitive layer comprise contains polyhydric alcohol.

(2) The silver halide light-sensitive photographic material described in (1), characterized in that the melting point of said UV absorbent is 35° C. or below.

(3) The silver halide light-sensitive photographic material described in (1) or (2) above, characterized in that said polyhydric alcohol is represented by the general formula I given below;

General Formula I $$R_1—O—R_2$$

wherein $R_1$ represents an alkyl group, alkenyl group, a cycloalkyl group, or a cycloalkenyl group; $R_2$ represents an alkyl group, an alkenyl group, a cycloalkyl group, a cycloalkenyl group, a —C (=O )—$R_3$ group, a $SO_2$—$R_4$ group, a —(O=) P<($OR_5$) ($OR_6$) group, a —(O=) P ($R_7$) ($R_8$) group, a —C(=O)—N($R_9$) ($R_{10}$) group or a —$SO_2N(R_{11})(R_{12})$ group, wherein $R_3$ through $R_9$ and $R_{11}$ independently represent an alkyl group, an alkenyl group, a cycloalkyl group, a cycloalkenyl group or an aryl group; $R_{10}$ and $R_{12}$ independently represent a hydrogen atom, an alkyl group, an alkenyl group, a cycloalkyl group, a cycloalkenyl group or an aryl group, provided that at least one of the alkyl group, the alkenyl group, the cycloalkyl group, the cycloalkenyl group represented by $R_1$ or at least one of the alkyl group, the alkenyl group, the cycloalkyl group, the cycloalkenyl group represented by $R_2$ or at least one of the alkyl group, the alkenyl group, the cycloalkyl group, the cycloalkenyl group represented by $R_3$ through $R_{12}$ is substituted by a hydroxyl group; that the total number of the hydroxyl group is two or more; and that $R_1$ and $R_2$ do not form a ring by combining with each other.

(4) The silver halide light-sensitive photographic material of material described in any one of (1), (2) and (3) mentioned above, characterized in that said polyhydric alcohol represented by the general formula I above is present in oleophilic fine particles containing a dye-forming coupler in an amount of not less than 50% by weight based on the coupler.

(5) The silver halide light-sensitive photographic material described in (1) or (2) above, characterized in that said polyhydric alcohol is a compound represented by the general formulae II through V below;

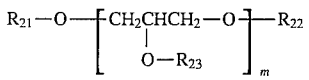

General Formula II wherein $R_{21}$, $R_{22}$ and $R_{23}$ independently represent a hydrogen atom, an alkyl group, an alkenyl group, a cycloalkyl group a cycloalkenyl group, an acyl group, a sulfonyl group, a phosphonyl group, a carbamoyl group or a sulfamoyl group; m represents an integer of 1 through 20, and when m is two or more, plurality of $R_{23}$'s may be either the same with or different from each other; provided that when m is one, any two of $R_{21}$, $R_{22}$ and $R_{23}$ are hydrogen atoms and the other is not a hydrogen atom, that when m is two or more, at least two of $R_{21}$, $R_{22}$ and the plurality of $R_{23}$'s are hydrogen atoms and the whole of them are not simultaneously hydrogen atoms.

General Formula III

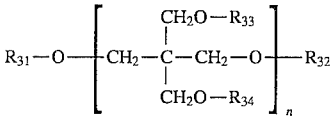

wherein $R_{31}$ through $R_{34}$ independently represent a hydrogen atom, an alkyl group, an alkenyl group, a cycloalkyl group, a cycloalkenyl group, an acyl group, a sulfonyl group, a phosphonyl group, a carbamoyl group or a sulfamoyl group; n represents an integer of 1 through 20, provided that when m is two or more, plurality of $R_{33}$' and $R_{34}$'s may be the same with or different from each other; that when n is one, at least two of $R_{31}$, $R_{32}$, $R_{33}$ and $R_{34}$ are hydrogen atoms and the whole of them are not simultaneously hydrogen atoms; and that when n is two or more, at least two of $R_{31}$, $R_{32}$, plurality of $R_{33}$'s and plurality of $R_{34}$'s are hydrogen atoms; and that the whole of them are not simultaneously hydrogen atoms;

General Formula IV

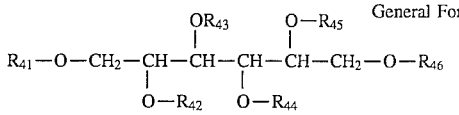

wherein $R_{41}$ through $R_{46}$ independently represent a hydrogen atom, an alkyl group, an alkenyl group, a cycloalkyl group, a cycloalkenyl group, an acyl group, a sulfonyl group, a phosphonyl group, a carbamoyl group or a sulfamoyl group, provided that at least two of $R_{41}$ through $R_{46}$ are hydrogen atoms and that the whole of them are not simultaneously hydrogen atoms;

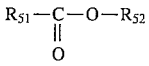

General Formula V wherein $R_{51}$ represents a substituted alkyl group or a substituted alkenyl group containing two or more hydroxyl group; $R_{52}$ represents an alkyl group, an alkenyl group, a cycloalkyl group, or a cycloalkenyl group, provided that $R_{51}$ and $R_{52}$ may be combined to form a lactone ring.

(6) The silver halide light-sensitive photographic material described in any one of (1), (2) and (5) above, wherein said polyhydric alcohol represented by the general formulae I through V above is present in oleophilic fine particles containing a dye-forming coupler in an amount of not less than 50% by weight with respect to the coupler.

(7) The silver halide light-sensitive photographic material described in (1) or (2) above, wherein said silver halide light-sensitive photographic material characterized in that said polyhydric alcohol is a compound represented by the general formulae VI or VII below:

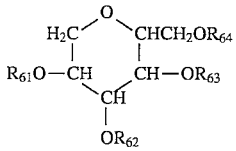

General Formula VI

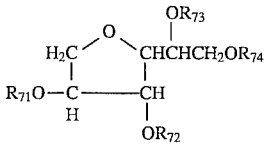

General Formula VII

In the general formulae VI and VII, $R_{61}$, $R_{62}$, $R_{63}$, $R_{64}$, $R_{71}$, $R_{72}$, $R_{73}$ and $R_{74}$ independently represent a hydrogen atom, an alkyl group, an alkenyl group, a cycloalkyl group, a cycloalkenyl group, an aryl group, an acyl group, a sulfonyl group, a phosphonyl group, a carbamoyl group or a sulfamoyl group, provided that at least two of $R_{61}$, $R_{62}$, $R_{63}$, $R_{64}$, $R_{71}$, $R_{72}$, $R_{73}$ and $R_{74}$ are hydrogen atoms and that they are not simultaneously hydrogen atoms.

(8) The silver halide light-sensitive photographic material described in any one of (1), (2) and (7) above, wherein said polyhydric alcohol represented by the general formula VI or VII above is present in oleophilic fine particles containing a dye-forming coupler in an amount of not less than 50% by weight with respect to the coupler.

(9) In the silver halide light-sensitive photographic material described in (1) or (2) above, said silver halide light-sensitive photographic material characterized in that said polyhydric alcohol is a compound represented by the general formulae VIII below:

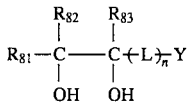

General Formula VIII wherein $R_{81}$, $R_{82}$ and $R_{83}$ independently represent a hydrogen atom, an alkyl group, an alkenyl group, a cycloalkyl group, a cycloalkenyl group, an aryl group or a carbamoyl group; L represents an alkylene group or an arylene group; Y represents a hydrogen atom, a carbamoyl group, a sulfamoyl group or an acyl group and n represents zero or one.

(10) In the silver halide light-sensitive photographic material described in any one of (1), (2) and (9) above, said polyhydric alcohol represented by the general formula VIII is present in oleophilic fine particles containing a dye-forming coupler in an amount of not less than 50% by weight with respect to the coupler.

(11) In the silver halide light-sensitive photographic material described in any one of (1) through (10) above, the light-sensitive layer containing said polyhydric alcohol comprises a compound represented by the general formula M-I below:

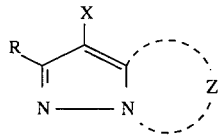

General Formula M-I wherein Z represents a group of non-metal atoms necessary to form a nitrogen-containing heterocycle, which may have a substituent; X represents a hydrogen atom or a group which is capable of being released upon coupling reaction with an oxidation product of a color developing agent and R represents a hydrogen atom or a substituent thereof.

(12) A method of processing an imagewise-exposed silver halide light-sensitive photographic material described in anyone of (1) through (11) above, characterized in that said silver halide light-sensitive photographic material is processed within four minutes in the total processing of color developing step to drying step.

(13) The silver halide light-sensitive photographic material described in any one of (1) through (11) above or the method of processing the silver halide light-sensitive photographic material described in (12) above, characterized in that a high boiling-point solvent is incorporated in the silver halide emulsion layer which comprises the polyhydric alcohol.

DETAILED EXPLANATION OF THE INVENTION

In the present invention, the term "polyhydric alcohol" means a compound which has in its molecule two or more alcoholic hydroxyl groups. To be more specific, it includes an aliphatic, an aromatic or a non-aromatic heterocycle compound, each of which has in the molecule two or more hydroxyl groups substituted thereto. The polyhydric alcohol of the present invention is preferably a compound containing six or more (preferably, 6 to 350) carbon atoms in the molecule. The polyhydric alcohol of the present invention is preferably a compound of which molecular weight is not more than 5000 (preferably, 100 to 5,000) and which is in the form of liquid at ordinary temperature. Further, preferable polyhydric alcohol of the present invention is a compound of which hydroxyl value is not less than 50, preferably and of which logP value is not less than three. The polyhydric alcohol of the present invention is, preferably, a compound represented by one of the above-mentioned general formulae I through VIII.

In the above-mentioned general formulae I through VIII, the alkyl group represented by $R_1$, $R_2$, $R_3$, $R_4$, $R_5$, $R_6$, $R_7$, $R_8$, $R_9$, $R_{10}$, $R_{11}$, $R_{12}$, $R_{21}$, $R_{22}$, $R_{23}$, $R_{31}$, $R_{32}$, $R_{33}$, $R_{34}$, $R_{41}$, $R_{42}$, $R_{43}$, $R_{44}$, $R_{45}$, $R_{46}$, $R_{52}$, $R_{61}$, $R_{62}$, $R_{63}$, $R_{64}$, $R_{71}$, $R_{72}$, $R_{73}$, $R_{74}$, $R_{81}$, $R_{82}$ and $R_{83}$, which is below referred to as $R_1$ through $R_{83}$, may be either straight chain or branched and, preferably one containing 1 to 32 carbon atoms. Specifically, for example, methyl group, ethyl group, isopropyl group, t-butyl group, dodecyl group, heptadecyl group and 2-ethylhexyl group can be mentioned as representative examples.

The alkenyl group represented by $R_1$ through $R_{83}$ may be either straight chain or branched, preferably containing 1 to 32 carbon atoms. More specifically, for example, vinyl group, propenyl group, 1,1-undecenyl group and 1-methylpropenyl group can be mentioned as representative examples.

The cycloalkyl group represented by $R_1$ through $R_{83}$ is preferably one having three to 12 and, more preferably, five to seven carbon atoms and it may have a branched structure.

Specifically, for example, cyclohexyl group, cyclopentyl group, cyclopropyl group and 2-methylcyclopropyl group can be mentioned as representative examples.

The cycloalkenyl group represented by $R_1$ through $R_{83}$ is preferably 1 containing three to 12 and, more preferably, five to seven carbon atoms. More specifically, for example, cyclohexenyl group and 2-cyclopentenyl group can be mentioned.

The aryl group represented by $R_3$, $R_4$, $R_5$, $R_6$, $R_7$, $R_8$, $R_9$, $R_{10}$, $R_{11}$, $R_{12}$, $R_{61}$, $R_{62}$, $R_{63}$, $R_{64}$, $R_{71}$, $R_{72}$, $R_{73}$, $R_{74}$, $R_{81}$, $R_{82}$ and $R_{83}$ is preferably one containing 6 to 14 carbon atoms. Specially, a phenyl group, 1-naphthyl group and 2-naphthyl group can be mentioned as representative examples.

The above-mentioned alkyl group, alkenyl group, cycloalkyl group, cycloalkenyl group and aryl group may be substituted by a substituent, including, for example, an alkyl group, an alkenyl group, a cycloalkenyl group, an alkinyl group, an aryl group, a heterocyclic group, an alkylthio group, an arylthio group, a heterocyclicthio group, a sulfonyl group, a sulfinyl group, an acyl group, a carbamoyl group, a sulfamoyl group, a cyano group, an alkoxy group, an aryloxy group, a heterocyclicoxy group, a siloxy group, an acyloxy group, a carbamoyloxy group, an amino group, an alkylamino group, an anilino group, an acylamino group, a sulfonamide group, an imide group, a ureide group, a sulfamoylamino group, an alkoxycarbonylamino group, an aryloxycarbonylamino group, an alkoxycarbonyl group, aryloxycarbonyt group, a spiro compound residue, a bridged compound residue, a halogen atom and a hydroxy group-;provided that in the case of $R_{81}$, $R_{82}$ and $R_{83}$, an alkyl group, an alkenyl group, a cycloalkenyl group, an alkinyl group, an aryl group, an alkylthio group, an arylthio group, a sulfonyl group, a sulfinyl group, an acyl group, a carbamoyl group, a sulfamoyl group, a cyano group an amino group, an alkylamino group, an anilino group, an acylamino group, a sulfonamide group, an imide group, a ureide group, a sulfamoylamino group, a halogen atom, a hydroxyl group. Among these, as more preferable groups, for example, an alkyl group, an aryl group, a halogen atom, an acylamino group, a sulfonyl group, a halogen atom and a hydroxyl group can be mentioned.

The substituted alkyl group or the substituted alkenyl group represented by $R_{81}$ represents the alkyl group or the alkenyl group, including one which is further substituted, represented by $R_1$ through $R_{52}$, arbitrary two hydrogen atoms of which are substituted by hydroxyl groups. As for representative examples, 1,2-dihydroxypropyl group, 1,1-dihydroxymethylethyl group, etc. can be mentioned.

As for the acyl group represented by $R_{21}$, $R_{22}$, $R_{23}$, $R_{31}$, $R_{32}$, $R_{33}$, $R_{34}$, $R_{41}$, $R_{42}$, $R_{43}$, $R_{44}$, $R_{45}$, $R_{46}$, $R_{61}$, $R_{62}$, $R_{63}$, $R_{64}$, $R_{71}$, $R_{72}$, $R_{73}$ and $R_{74}$, which are hereinafter referred to as "$R_{21}$ through $R_{74}$", and Y, a group represented by $—C(=O)—R_3$, in which $R_3$ denotes the same as defined hereinabove, is preferable.

As the sulfonyl group represented by $R_{21}$, $R_{22}$, $R_{23}$, $R_{31}$, $R_{32}$, $R_{33}$, $R_{34}$, $R_{41}$, $R_{42}$, $R_{43}$, $R_{44}$, $R_{45}$, $R_{46}$, $R_{61}$, $R_{62}$, $R_{63}$, $R_{64}$, $R_{71}$, $R_{72}$, $R_{73}$ and $R_{74}$, which are hereinafter referred to as $R_{21}$ through $R_{74}$, and Y, a group represented by $—SO_2—R_4$, wherein $R_4$ denotes the same as defined hereinabove, is preferable and as for the phosphonyl group represented by $R_{21}$ through $R_{74}$ a group represented by $—(O=)P<(OR_5)(OR_6)$, wherein $R_5$ and $R_6$respectively represent the same as defined hereinabove, is preferable.

As for the sulfamoyl group represented by $R_{21}$ through $R_{74}$, $R_{81}$, $R_{82}$, $R_{83}$ and Y, a group represented by $—SO_2N<(R_{11})(R_{12})$, wherein $R_{11}$ and $R_{12}$, respectively represent the same as defined hereinabove, is preferable.

In the general formulae I and VIII above, $R_1$ and $R_2$, $R_{81}$ and $R_{82}$, $R_{82}$ and $R_{83}$, $R_{81}$ and Y, and $R_{83}$ and Y respectively do not form a ring by being fused with each other.

$R_5$ and $R_6$, $R_7$ and $R_8$, $R_9$ and $R_{10}$ and $R_{11}$ and $R_{12}$ may respectively form a ring by being combined with each other.

In the general formula II, arbitrary two of $R_{21}$, $R_{22}$ and $R_{23}$ (when m is two or more, they may respectively be regarded as so many substituents)may form a ring by being fused with each other.

In the general formula III, arbitrary two of $R_{31}$, $R_{32}$, $R_{33}$ and $R_{34}$ (when m is two or more, each of plural $R_{33}$ and $R_{34}$ may respectively be regarded as a substituent) may form a ring by being combined with each other.

In the general formula IV, arbitrary two of $R_{41}$, $R_{42}$, $R_{43}$, $R_{44}$, $R_{45}$ and $R_{46}$ may form a ring by being combined with each other.

In the general formulae VI and VII, $R_{61}$ and $R_{62}$ and/or $R_{62}$ and $R_{63}$ and/or $R_{63}$ and $R_{64}$ may respectively form a ring by being combined with each other.

As for the alkylene group represented by L, it may be either straight chain or branched and it includes, for example, ethylene group, 1-methylethylene group and propylene group.

As for the arylene group represented by L, for example, p-phenylene group, o-phenylene group, and 1,4-naphthylene group can be mentioned. The alkylene group and the arylene group represented by L may be substituted and as such a substituent the same substituents as defined for $R_1$ through $R_3$ can be mentioned.

The polyhydric alcohol of the present invention preferably has a molecular weight of not more than 5000 ant it is in the state of liquid under the normal temperature.

preferable polyhydric alcohol according to the present invention is a compound of which hydroxyl value is 50 or more.

Further, preferable polyhydric alcohol according to the present invention has logP value of not less than three.

Below, representative examples of the polyhydric alcohol of the present invention are shown, however, the scope of the present invention is not limited by them.

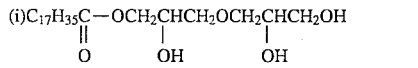

II-1

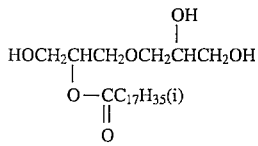

II-2

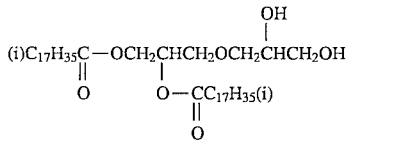

II-3

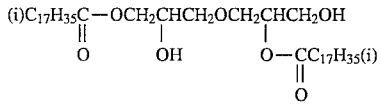

II-4

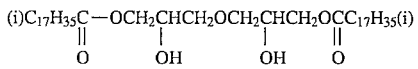

II-5

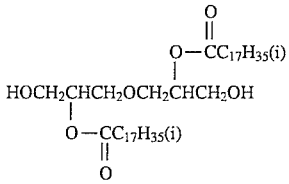

II-6

-continued
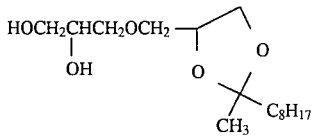
II-7
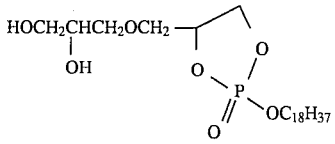
II-8
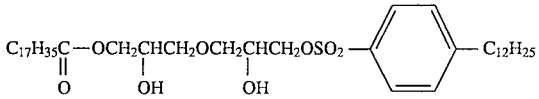
II-9
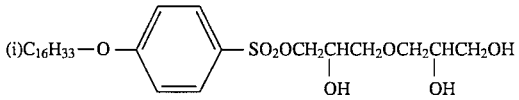
II-10
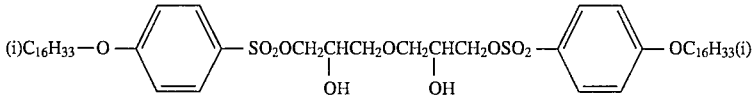
II-11
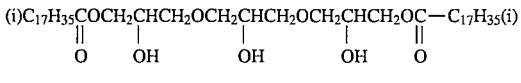
II-12
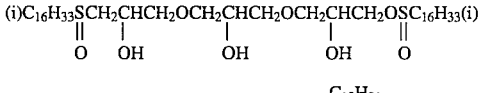
II-13
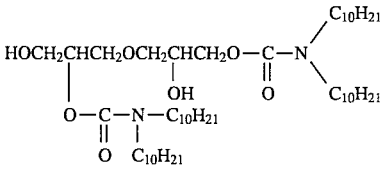
II-14
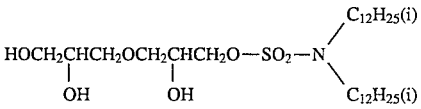
II-15
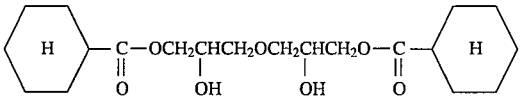
II-16
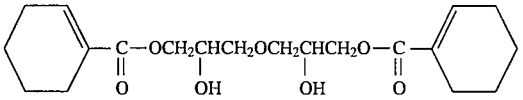
II-17
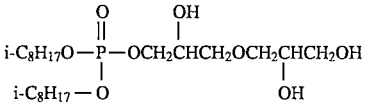
II-18
Decaglyceryltristearate. II-19
Decaglycerylpentaoleate. II-20
Decaglycerylheptaisostearate. II-21
Hexaglyceryltristearate. II-22
Hexaglycerylmonooleate. II-23
Tetraglyceryltristearate. II-24
Tetraglycerylmonooleate II-25
$C_8H_{17}CH{=}CH(CH_2)_7COO-CH_2CH(OH)-CH_2OH$ II-26
$(i)C_{17}H_{35}COO-CH\langle(CH_2OH)_2$ II-27

-continued
III-1
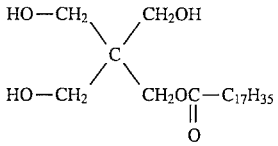
III-2
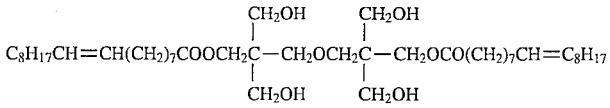
III-3
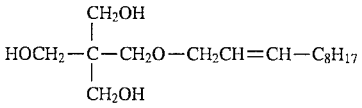
III-4
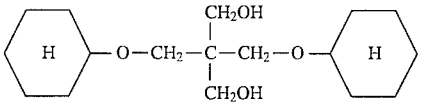
III-5
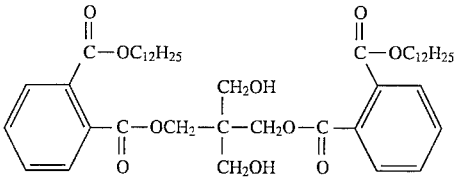
III-6
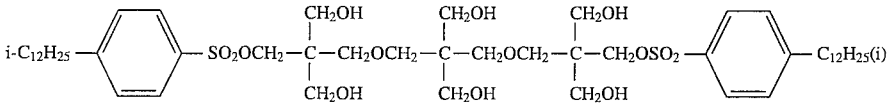
III-7
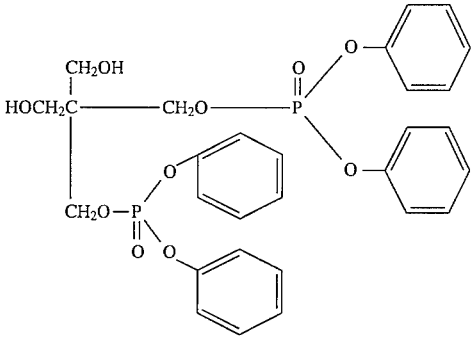
III-8
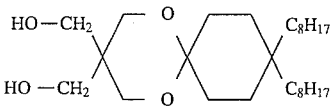
III-9
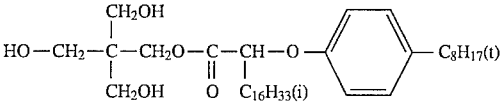
III-10
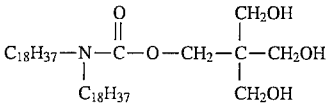
III-11
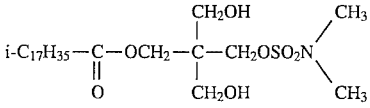

-continued
III-12
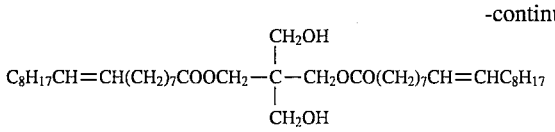
IV-1
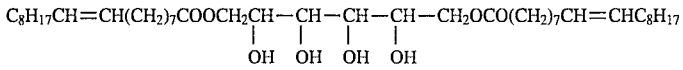
IV-2
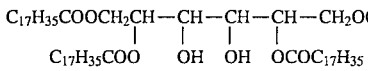
IV-3
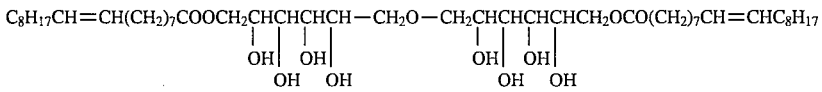
IV-4
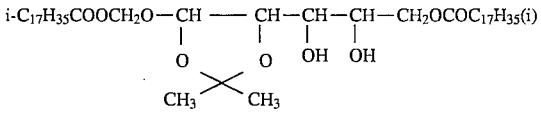
IV-5
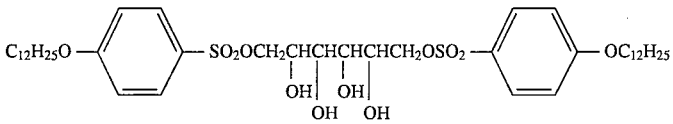
IV-6
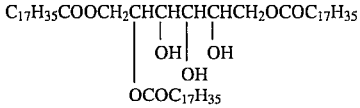
IV-7
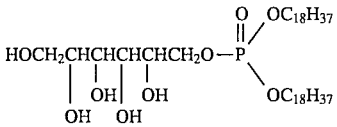
V-1
V-2
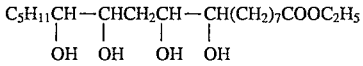
V-3
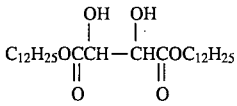
V-4
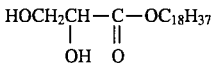
V-5
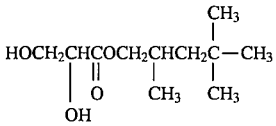
V-6
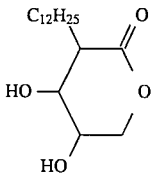

-continued
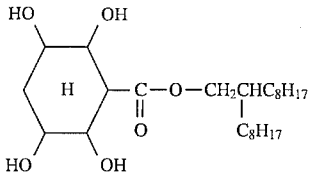
V-7
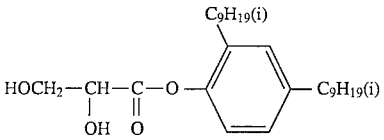
V-8
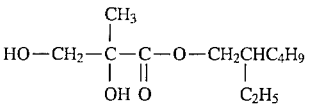
V-9
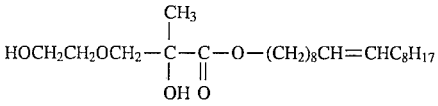
V-10
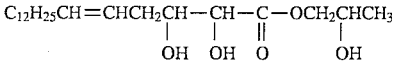
V-11
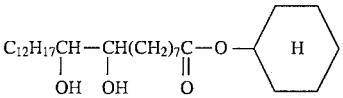
V-12
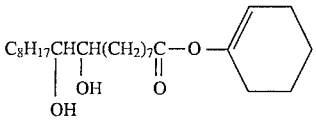
V-13
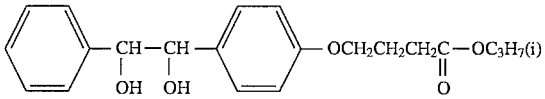
V-14
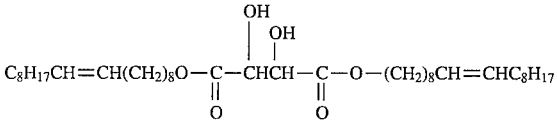
V-15
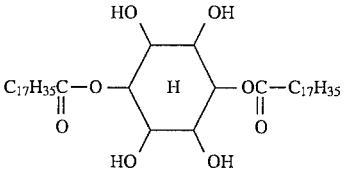
IA-1
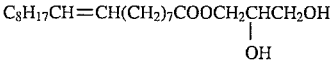
IA-2
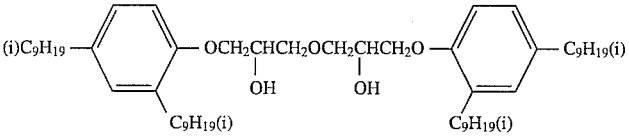
IA-3
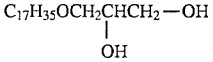
IA-4
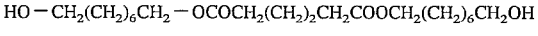
IA-5

-continued
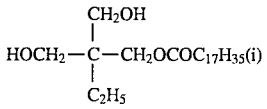
IA-6
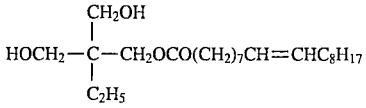
IA-7
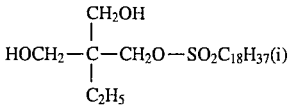
IA-8
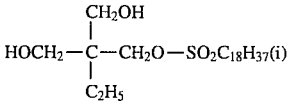
IA-8
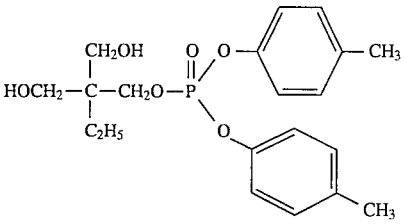
IA-9
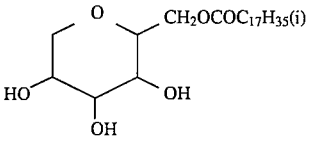
VI-1
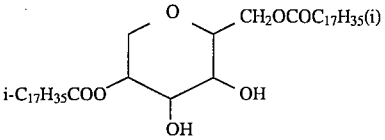
VI-2
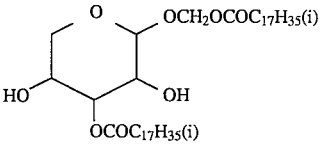
VI-3
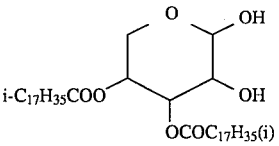
VI-4
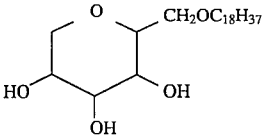
VI-5
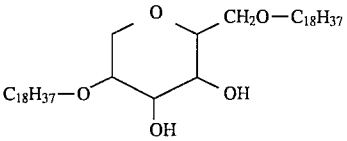
VI-6

-continued
VI-7
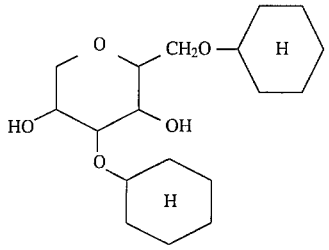
VI-8
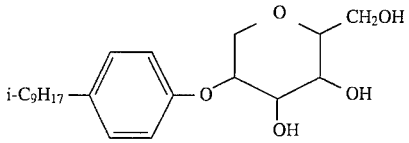
VI-9
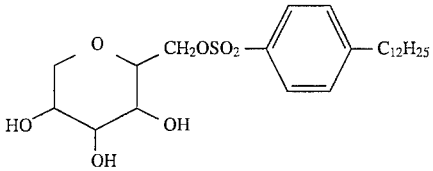
VI-10
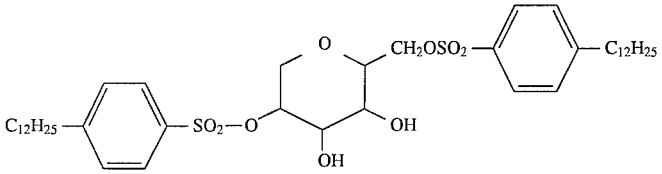
VI-11
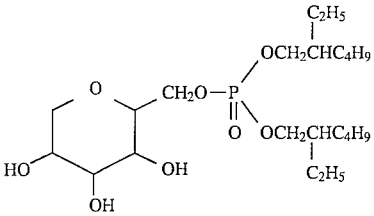
VI-12
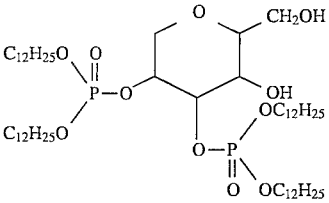
VI-13
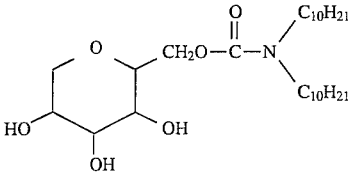
VI-14
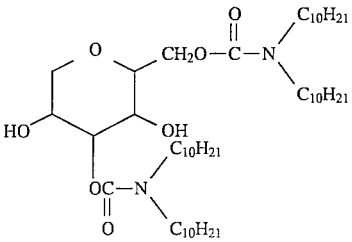

-continued
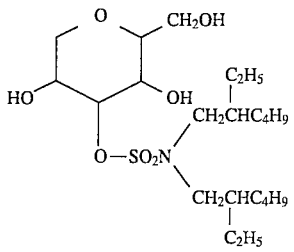
VI-15
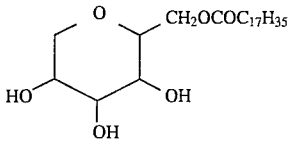
VI-16
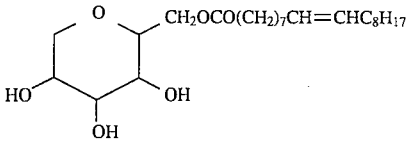
VI-17
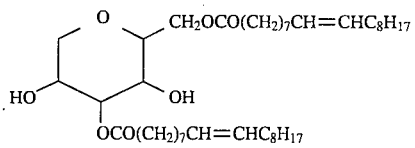
VI-18
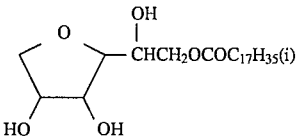
VII-1
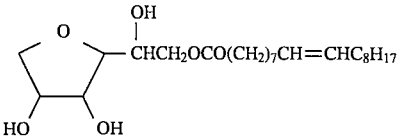
VII-2
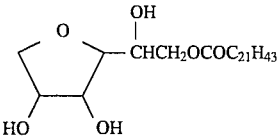
VII-3
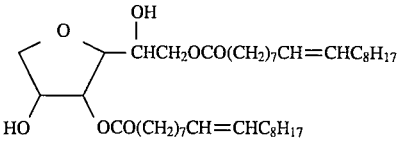
VII-4
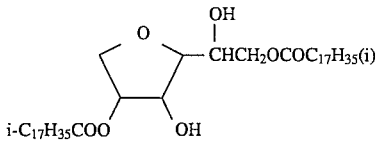
VII-5
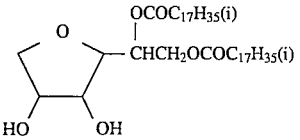
VII-6

-continued
VII-7
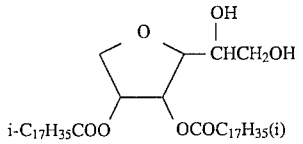
VII-8
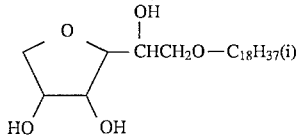
VII-9
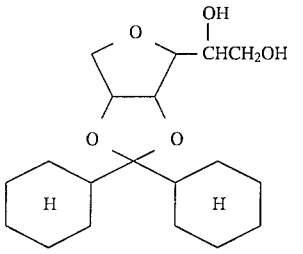
VII-10
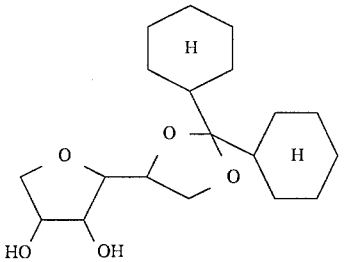
VII-11
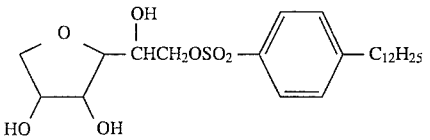
VII-12
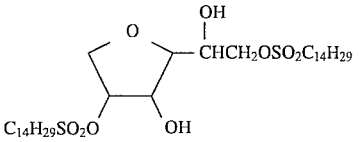
VII-13
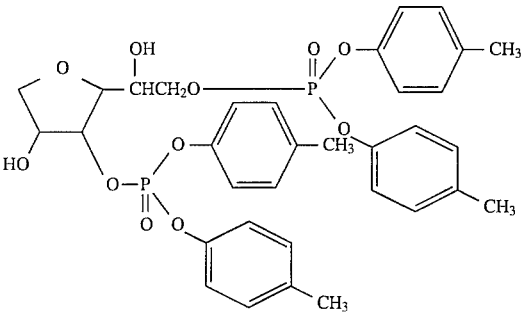
VII-14
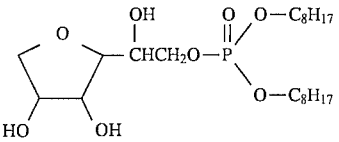

-continued
VII-15
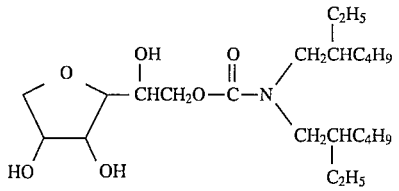
VII-16
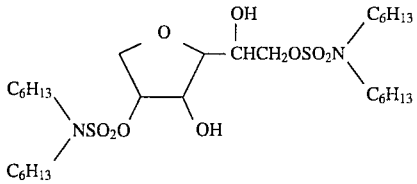
VIII-1
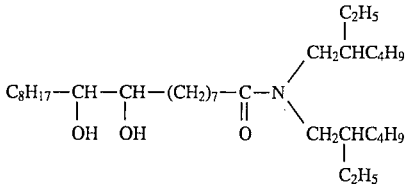
VIII-2
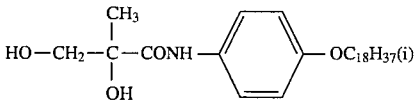
VIII-3
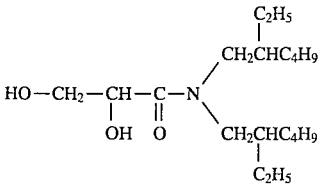
VIII-4
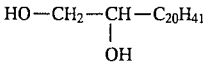
VIII-5
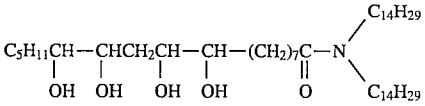
VIII-6
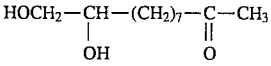
VIII-7
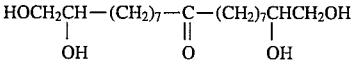
VIII-8
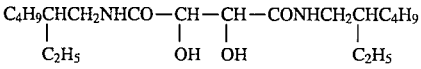
VIII-9
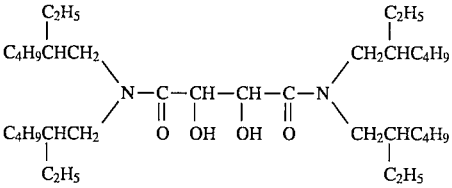
VIII-10
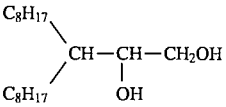
VIII-11
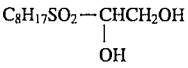

-continued
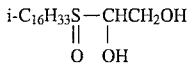
VIII-12
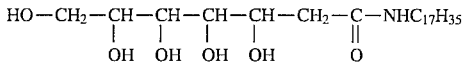
VIII-13
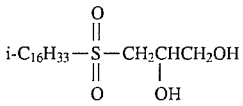
VIII-14
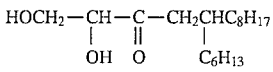
VIII-15
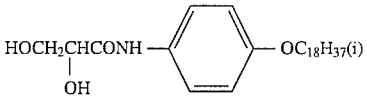
VIII-16
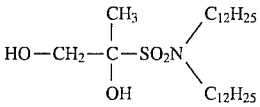
VIII-17
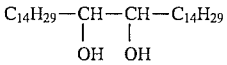
VIII-18
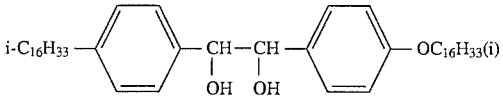
VIII-19
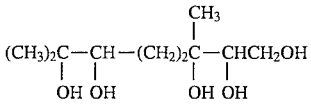
VIII-20
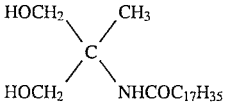
IX-1
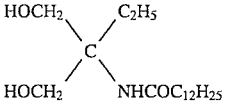
IX-2
IX-3
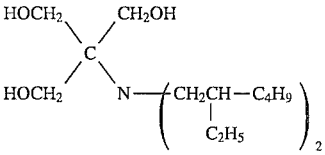
IX-4
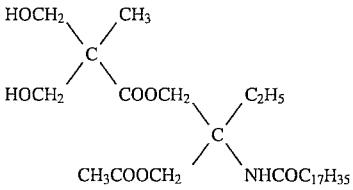
IX-5
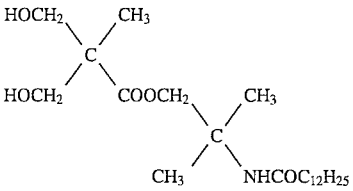

-continued
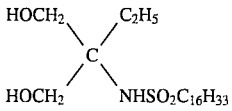
IX-6
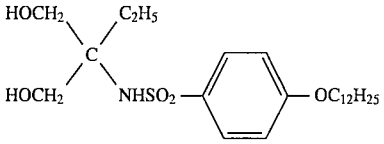
IX-7
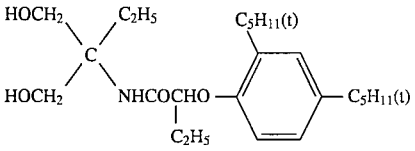
IX-8
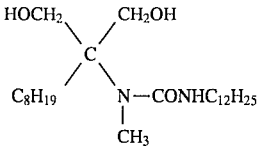
IX-9
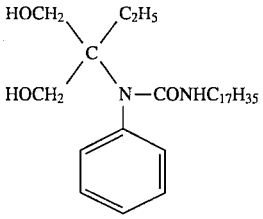
IX-10
Furthermore, the following compounds are cited.
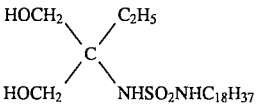
IX-11
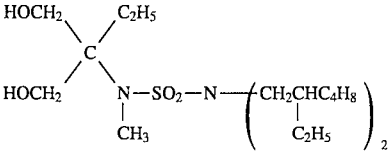
IX-12
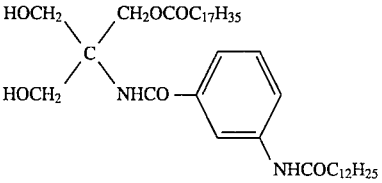
IX-13
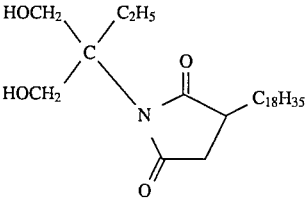
IX-14
-continued
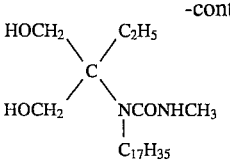
IX-15
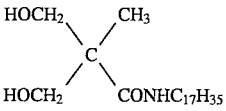
X-1
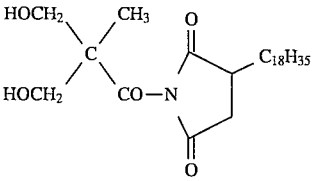
X-2
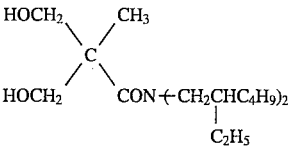
X-3
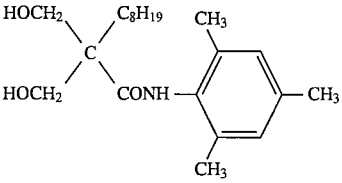
X-4

-continued

X-5

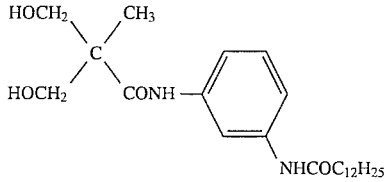

X-6

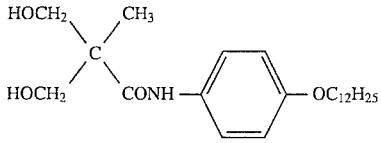

X-7

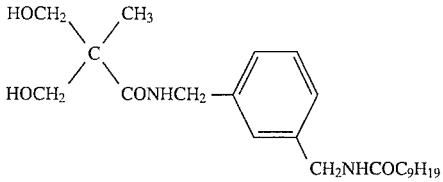

X-8

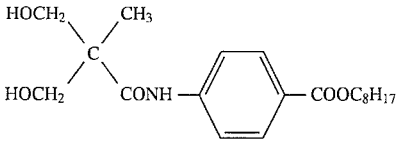

X-9

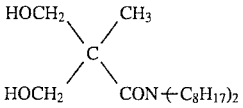

X-10

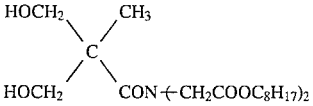

X-11

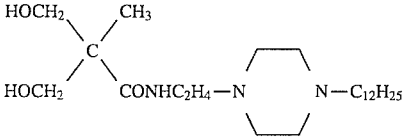

XI-1

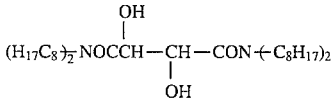

XI-2

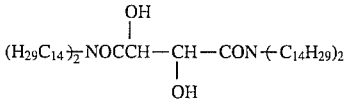

XI-3

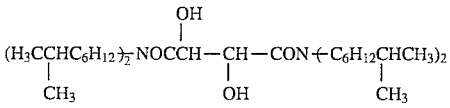

XI-4

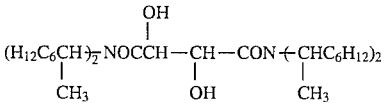

XI-5

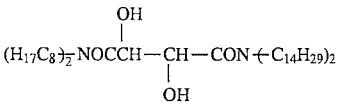

Next, the UV absorbent of the present invention is explained.

The UV absorbent used in the present invention may be any one that is in the form of liquid at ordinary temperature. In this case, the term "in the form of liquid at ordinary temperature" means that it is in the state of liquid at 35° C. or below, and, more preferably, at 15° C. or below.

As for the UV absorbent which may suitably be used in the present invention, for example, benztriazole-type, thiazolidone-type, acrylonitrile-type, benzophenone-type and aminobutadiene-type UV absorbents can be mentioned. Among these UV absorbents, benzotriazole-type UV absorbent is preferably employed in the present invention.

The UV absorbent of the present invention, which is in the liquid form at ordinary temperature may be used in combination with other UV absorbent which is in the form of solid at ordinary temperature.

Specific examples of the UV absorbent of the present invention are shown below, however, the scope of the present invention is not limited to these.

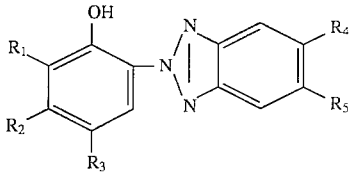

| | $R_1$ | $R_2$ | $R_3$ | $R_4$ | $R_5$ |
|---|---|---|---|---|---|
| UV-1 | H | H | H | H | H |
| UV-2 | $CH_3$ | H | H | H | H |
| UV-3 | $C_4H_9$ (t) | H | H | H | H |
| UV-4 | $C_5H_{11}$ (s) | H | H | H | H |
| UV-5 | $C_{12}H_{25}$ | H | H | H | H |
| UV-6 | $C_{16}H_{33}$ | H | H | H | H |
| UV-7 | $OCH_3$ | H | H | H | H |
| UV-8 | $C_2H_4COOC_8H_{17}$ | H | H | H | H |
| UV-9 | $CONHC_{12}H_{25}$ | H | H | H | H |
| UV-10 | $CH_3$ | H | $C_4H_9$ (t) | H | H |
| UV-11 | $C_4H_9$ (s) | H | $C_4H_9$ (s) | H | $C_4H_9$ (t) |
| UV-12 | $C_4H_9$ (s) | H | $C_4H_9$ (t) | H | $C_4H_9$ |
| UV-13 | $C_4H_9$ (t) | H | $C_{12}H_{25}$ | H | H |
| UV-14 | $C_{12}H_{25}$ | H | $CH_3$ | H | H |
| UV-15 | H | H | $C_5H_9$ (t) | H | Cl |
| UV-16 | $C_4H_9$ (t) | H | $C_4H_9$ (t) | H | Cl |
| UV-17 | $C_4H_9$ (t) | H | $C_4H_9$ (t) | H | $C_4H_9$ (t) |
| UV-18 | $C_{12}H_{25}$ | H | $CH_3$ | H | $OC_4H_9$ |
| UV-19 | $C_{12}H_{25}$ | H | $C_{12}H_{25}$ | H | $OCH_3$ |
| UV-20 | $C_4H_9$ (t) | H | $CH_3$ | $OC_8H_{17}$ | $OC_8H_{17}$ |
| UV-21 | H | H | $C_4H_9$ | H | $C_4H_9$ |
| UV-22 | $OC_4H_9$ | H | $OC_4H_9$ | H | $C_{12}H_{25}$ |
| UV-23 | Cl | H | Cl | H | $C_{12}H_{25}$ |
| UV-24 | $C_5H_{11}$ (t) | H | $C_5H_{11}$ (t) | $OCH_3$ | H |
| UV-25 | $C_4H_9$ (s) | H | $C_4H_9$ (s) | H | $OCH_3$ |

Next, the compound represented by the general formula M-I, which may also be referred to as the coupler represented by the general formula M-I, is explained below.

General Formula M-I

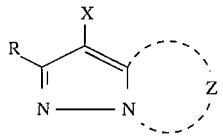

In the general formula M-I, there is no specific limitation as to the substituent represented by R, representative examples include, for example, an alkyl group, an aryl group, an anilino group, an acylamino group, a sulfonamide group, an alkylthio group, an arylthio group, an alkenyl group, a cycloalkyl group can be mentioned. Besides those mentioned above, a halogen atom, a cycloalkenyl group, an alkinyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclicoxy group, a silomy group, an acyloxy group, a carbamoyloxy group, an amino group, an alkylamino group, an imide group, a ureide group, a sulfamoylamino group, an alkoxycarbonylamino group, an aryloxycarbonylamino group, an alkoxycarbonyl group, an aryloxycarbonyl group, a heterocyclicoxythio group, a spiro compound residue and a bridged compound residue can be mentioned.

As for the alkyl group represented by R, one containing 1 to 32 carbon atoms can be mentioned and it may be either straight chain or branched.

As for the aryl group represented by R, phenyl group is preferable,

As for the acylamino group represented by R, for example, an alkylcarbonylamino group and an arylcarbonylamino group can be mentioned.

As for the sulfonamide group represented by R, for example, an alkylsulfonylamino group and an arylsulfonylamino group can be mentioned.

The alkyl component or the aryl component in the alkylthio group or the arylthio group represented by R is the same as alkyl or aryl above-mentioned.

As for the alkenyl group represented by R, one containing 2 to 32 carbon atoms; as for the cycloalkyl group, one containing 3 to 12 carbon atoms and, more preferably, 5 to 7 carbon atoms is preferable. The alkenyl group may be either straight chain or branched.

As for the cycloalkenyl group represented by R, one that contains 3 to 12 carbon atoms and, especially one containing 5 to 7 carbon atoms is preferable.

As for the sulfonyl;group, for example, an alkylsulfonyl group and an arylsulfonyl group;

As for the sulfinyl group, for example, an alkylsulfinyl group and arylsulfinyl group;

As for the phosphonyl group, for example, an alkylphosphonyl group, an alkoxyphosphonyl group, an aryloxyphosphonyl group and an arylphosphonyl group;

As for the acyl group, for example, an alkylcarbonyl group, and an arylcarbonyl group;

As for the carbamoyl group, for example, an alkylcarbamoyl group and an arylcarbamoyl group and an arylcarbamoyl group; As for the sulfamoyl group, for example, an alkylsulfamoyl group, and arylsulfamoyl group; As for the acyloxy group, for example, an alkylcarbonyloxy group and an arylcarbonyloxy group; As for the carbamoyloxy group, for example, an alkylcarbamoyloxy group and an arylcarbamoyloxy group; As for the ureide group, for example, an alkyl ureide group and an arylureide group; As for the sulfamoylamino group, for example, an alkylsulfamoylamino group and an arylsulfamoylamino group; As the heterocyclic group, a five to seven member ring is preferable and specifically, for example, a 2-furyl group, 2-thienyl group, 2-pyrimidyl group and 2-benzthiazole group; As for the heterocyclic-oxy group, one having a five- to seven-member ring is preferable and, specifically, for example, 3,4,5,6-tetrahydropyranyl-2-oxy group and 1-phenyltetrazole-5-oxy group; As for the siloxy group, for example, trimethylsiloxy group, triethylsiloxy group and dimethylbutylsiloxy group; As for the imide group, for example, a succinicimide group, 3-heptadecylsuccinicimide group, a phthalimide group and a glutalimide group; As for the spiro compound residue, for example, spiro[3,3]heptane-1-il and as for the bridged compound residue, for example, bicyclo[2,2,1]heptane-1-il, tricyclo[3.1.13.17]decane-1-il and 7,7-dimethyl-bicyclo[2.2.1]heptane-1-il can be mentioned.

As for the group which is capable of being released by the reaction with an oxidation product of a color developing agent, for example, a halogen atom such as chlorine, bromine and fluorine, an alkoxy group, an aryloxy group, a heterocyclic-oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic-thio group, an alkyloxythiocarbonylthio group, an acylamino group, a sulfonamide group, a nitrogen-containing heterocyclic group, an alkyloxycarbonylamino group, an aryloxycarbonylamino group, a carboxyl group and a group represented by the following formula can be mentioned.

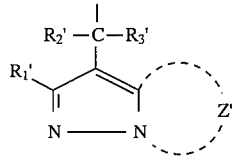

wherein R' has the same definition as R above; Z' has the same definition as Z above; $R_2'$ and $R_3'$ independently represent a hydrogen atom, an aryl group, an alkyl group or a heterocyclic group. Preferably, X is a halogen atom and, especially, it is a chlorine atom.

As for the nitrogen-containing heterocyclic ring, for example, a pyrazole ring, an imidazole ring, a triazole ring and a tetrazole ring can be mentioned and as for the substituent the above-mentioned heterocyclic ring has, for example those groups as defined for the above-mentioned R can be mentioned.

The compound represented by the general formula M-I is, more specifically expressed by the following general formulae M-II through M-VII:

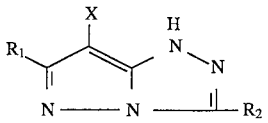

General Formula M-II

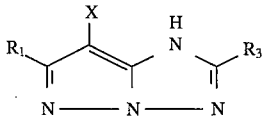

General Formula M-III

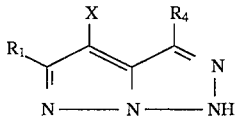

General Formula M-IV

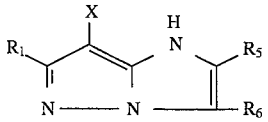

General Formula M-V

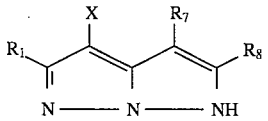

General Formula M-VI

-continued

General Formula M-VII

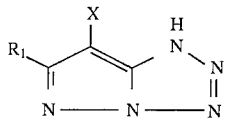

In the above-mentioned general formulae M-II through M-VII, $R_1$ through $R_8$ and X have the same meaning as R and X, respectively.

Among couplers represented by the above-mentioned general formulae M-II through M-VII, couplers represented by the general formulae M-II and M-III are preferable. Still more preferable couplers are those represented by the following formulae M-VIII and M-IX General Formula M-VIII

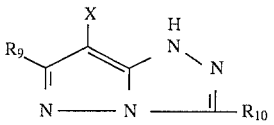

in the general formula M-VIII, $R_9$ and $R_{10}$ independently represent an alkyl group; X has the same definition as in the above-mentioned general formula M-I. As for the alkyl group represented $R_9$ or $R_{10}$, one containing one to 32 carbon atoms is preferable and they may be either straight chained, branched or substituted. As for the substituent for the alkyl groups represented by $R_9$ and $R_{10}$, the same substituents mentioned as to R in the general formula M-I can be mentioned. Further it is preferable that $R_9$ is either a secondary or a tertiary alkyl group.

General Formula M-IX

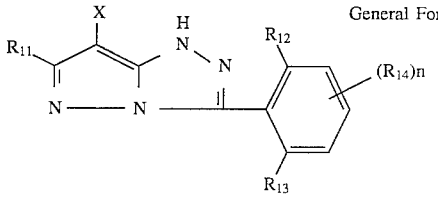

In the general formula M-IX, $R_{11}$ and X respectively have the same definitions as R and X in the above-mentioned general formula M-I; $R_{12}$ represents a hydrogen atom or a substituent thereof; $R_{13}$ and $R_{14}$ independently represent a substituent; and n represents an integer of zero to three. As for the substituent represented by $R_{12}$, $R_{13}$ and $R_{14}$, the same substituents mentioned with respect to R in the general formula M-I can be mentioned and, preferably, they are independently selected from an alkyl group, an alkoxy group, an acylamino group, a sulfonamide group, a ureide group, a sulfonyl group, an imide group and a halogen atom.

Below, specific examples of the compound represented by the general formula M-I are shown:

M-1

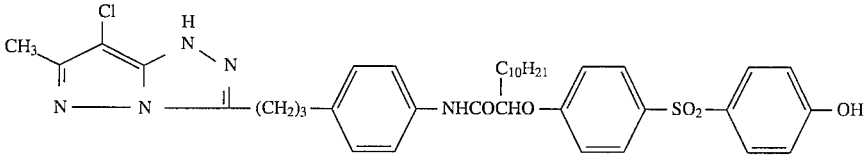

M-2

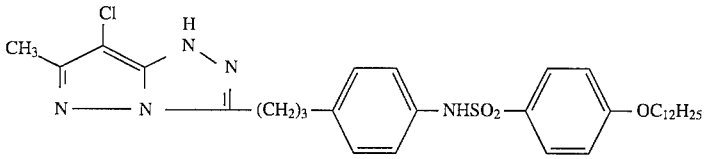

M-3

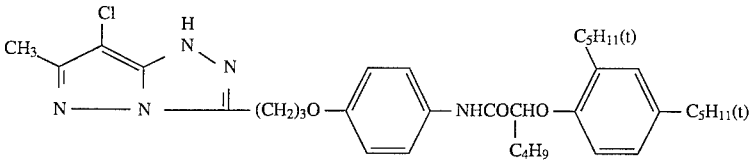

M-4

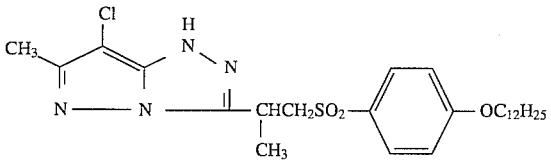

M-5

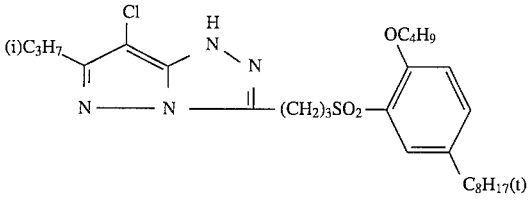

M-6

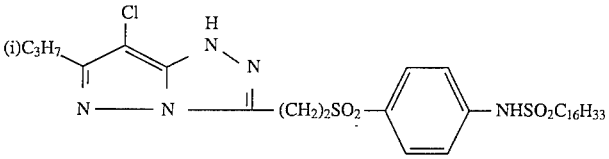

-continued
M-7
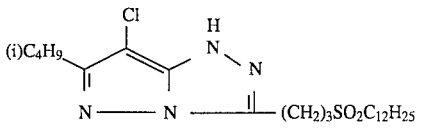
M-8
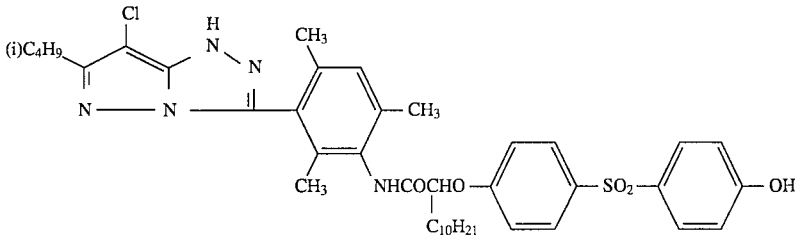
M-9
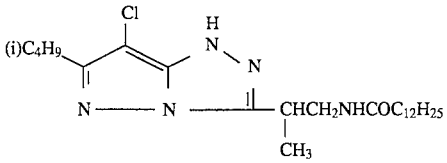
M-10
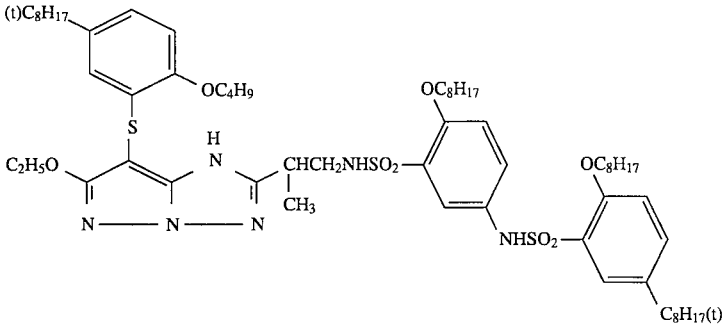
M-11
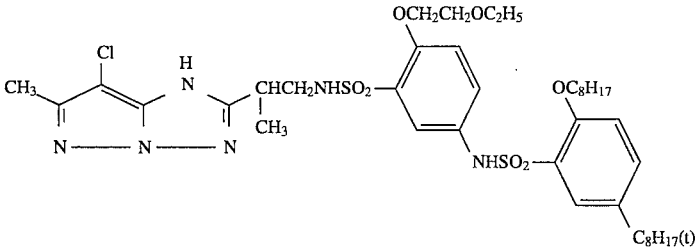
M-12
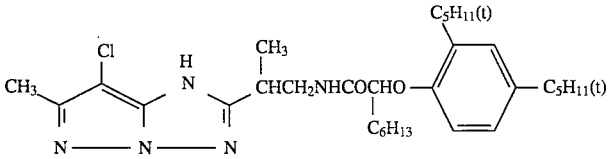
M-13
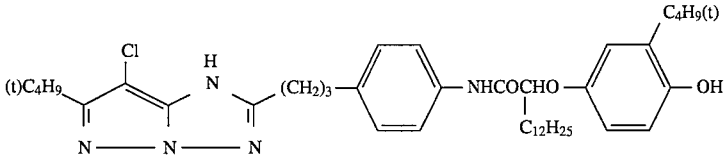
M-14
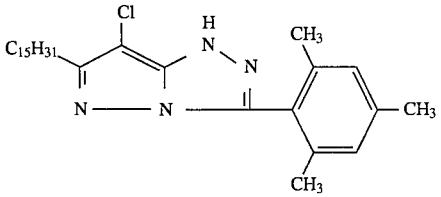

-continued

M-15

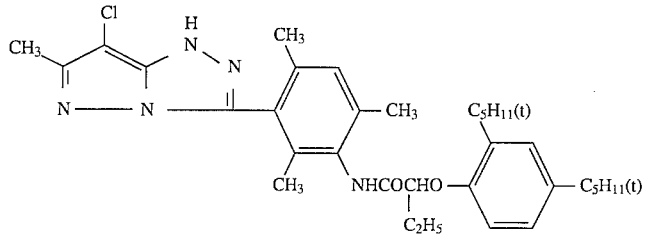

M-16

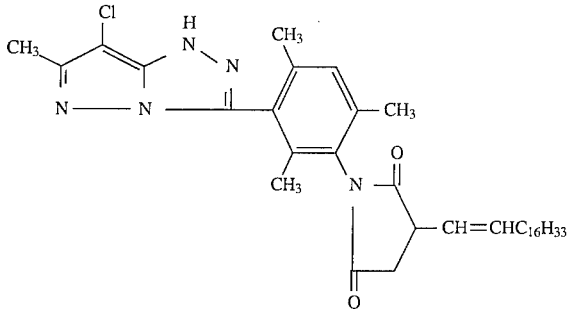

M-17

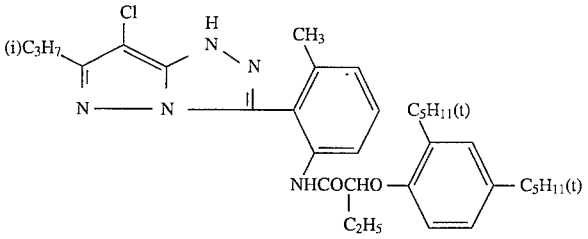

M-18

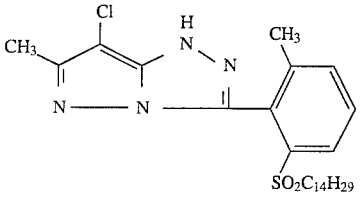

M-19

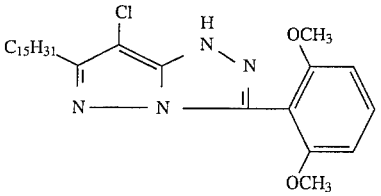

M-20

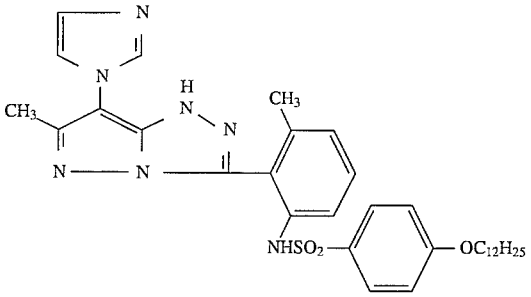

Besides those specific examples shown above, as for the coupler according to the present invention, exemplified compounds Nos. 1 through 64 disclosed on pages 5 through 9 of Japanese Patent O.P.I. Publication No. 63253946(1988); exemplified compounds M-1 through M-29 disclosed on pages 5 and 6 of Japanese Patent O.P.I. Publication No. 2-100048(1990); exemplified compounds M-16 through M-34, M-37 through M-39 and M-41 through M-47 disclosed on pages 106 through 114 of Japanese Patent O.P.I. Publication No. 62-215272(1987); exemplified Compounds M-1 through M-15 disclosed on pages 12 through 14 of Japanese Patent O.P.I. Publication No. 2-96133(1990); exemplified compounds Nos. 1 through 7 disclosed on page 7 of Japanese Patent O.P.I. Publication No.

61-292143(1986); exemplified compounds Nos. 1 through 11, 15, 16, 18 through 28 and 30 through 41, disclosed on pages 19 through 32 of Japanese Patent O.P.I. Publication No. 3-125143(1991); exemplified compounds Nos. 1 through 24 disclosed on pages 3 through 5 of Japanese Patent O.P.I. Publication No. 4-128744(1992) and exemplified compounds Nos. 1 through 22 disclosed on pages 5 through 7 of Japanese Patent O.P.I. Publication No. 4-242249(1992) can be mentioned.

These couplers can usually be used in an amount of $1\times10^{-3}$ to 2 and,-more preferably $1\times10^{-2}$ to $7\times10^{-1}$ mol per a mol of silver halide.

The high boiling-point organic solvent used in the present invention usually is one, of which boiling point is not less than 150° C., however, it may be one which is in the solid state at ordinary temperature so long as it is well miscible with the coupler. Preferable high boiling-point organic solvent used in the present invention has vapor pressure at 100° C. of not more than 0.5 mmHg and solubility in water at 25° C. is not more than 1% by weight.

The amount of the high boiling-point organic solvent to be incorporated in the same silver halide emulsion layer in which the dye-forming coupler (magenta coupler) represented by the general formula M-I is generally 2.5 or more in a weight ratio based on the dye-forming coupler. The ratio is, more preferably, between 2,5 and 10 and, still more preferably, it is between 3.0 and 6.0.

The high boiling-point organic solvent which is suitably used in the present invention is a compound represented by either one of the general formulae H-1 through H-4 below:

$$R_{H1}-COO-R_{H2} \quad \text{(H-1)}$$

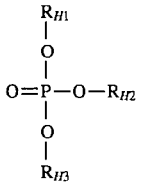

(H-2)

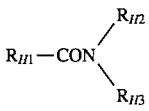

(H-3)

$$R_{H1}-O-R_{H2} \quad \text{(H-4)}$$

In the formulae, $R_{H1}$, $R_{H2}$ and $R_{H3}$ independently represent an alkyl group, cycloalkyl group, alkenyl group, aryl group or heterocyclic group, each of which may be substituted, provided that in the general formula H-4, $R_{H1}$ and $R_{H2}$ may form a ring by combining with each other.

Specific examples of the high boiling-point organic solvent used in the present invention are shown below, however, the scope of the invention is not limited to them.

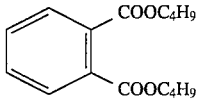

(S-1)

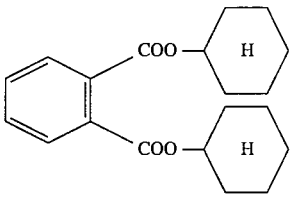

(S-2)

-continued

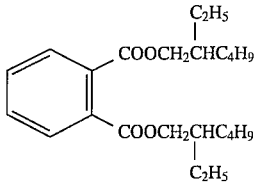

(S-3)

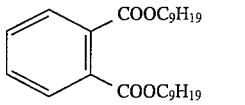

(S-4)

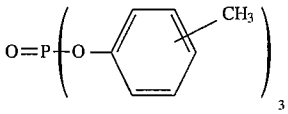

(S-5)

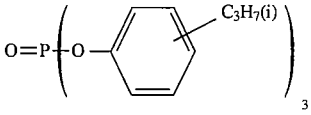

(S-6)

$$O=P\left(O-C_9H_{19}(i)\right)_3 \quad \text{(S-7)}$$

$$O=P\left(O-C_8H_{17}\right)_3 \quad \text{(S-8)}$$

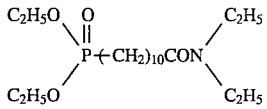

(S-9)

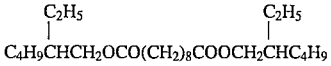

(S-10)

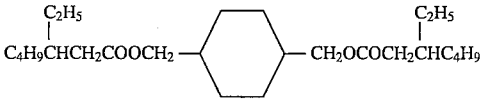

(S-11)

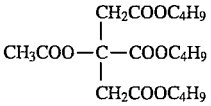

(S-12)

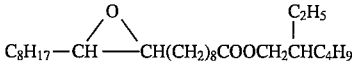

(S-13)

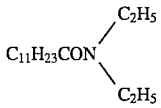

(S-14)

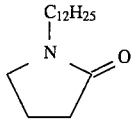

(S-15)

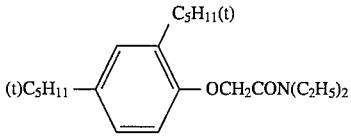

(S-16)

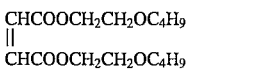

(S-17)

Besides those compounds mentioned above, as the high boiling-point organic solvent used in the present invention, for example, exemplified compounds II-1 through II-29 and H-1 through H-22 disclosed on pages 8, 9, 14 and 15 of Japanese Patent O.P.I. Publication No. 1-196048(1989); exemplified compounds S-1 through S-69 disclosed of pages 3 through 7 of Japanese Patent O.P.I. Publication No. 1-209446(1989); exemplified compounds I-1 through 1-95 disclosed on pages 10 through 12 of Japanese Patent O.P.I. Publication No. 63-253943(1988) and exemplified compounds S-1 through S-74 disclosed on pages 6 through 9 of Japanese Patent O.P.I. Publication No. 4-147136(1992) can be mentioned.

These high boiling-point organic solvent can be incorporated in the objective hydrophilic colloidal layer after being dissolved using a high boiling-point organic solvent and, if necessary, other low-boiling-point organic solvent or a water-miscible solvent together with, if necessary other hydrophobic additive such as a dye-forming coupler and dispersed in an aqueous solution containing a hydrophilic binder such as gelatin using a surface active agent in a dispersing apparatus such as a mixer, a homogenizer, colloid mill, a flow-jet mixer or a ultrasonic mixer.

In the silver halide light-sensitive photographic material of the present invention, it is preferable that weight proportion between the polyhydric alcohol and the above-mentioned dye-forming coupler (polyhydric alcohol/dye-forming coupler) is between 0.5 and 5.

It is preferable that the silver halide emulsion used in the silver halide light-sensitive photographic material of the present invention contains 95 to 99.95 mol% of silver chloride and, more preferably, it is silver chloride which is substantially free of silver iodide. Preferable silver chloride content is 97 to 99.9 mol%. Further in view of shortening color developing process and reducing the amount of replenishing color developing solution, 99.5 to 99.9 mol% is more advantageous.

The shape of the silver halide crystal used in the silver halide light-sensitive photographic material of the present invention can be any arbitrary shape known in the art.

One of the preferable embodiment is to use a silver halide emulsion containing cubic-shaped silver halide crystals, which have (100) crystalographic faces on the surface. It is also possible to use a silver halide emulsion containing octahedral, tetradecahedral or dodecahedral silver halide grains prepared according to the methods disclosed, for example, in U.S. Pat. Nos. 4,183,756 and 4,225,666; Japanese patent O.P.I Publication No. 55-26539(1980), Japanese Patent publication No. 55-42737(1980) and The Journal of Photographic Science 21,39(1973). Further, crystals having twin planes may also be employed.

The silver halide crystals used in the light-sensitive material of the present invention may consist of either a unified single shaped crystals or a mixture of crystals of variety of different shapes.

Although there is no specific limitation as to the grain size of the silver halide crystal used in the light-sensitive material of the present invention, taking other photographic properties such as accessibility to rapid processing and sensitivity into consideration, it is usually within a range between 0.1 and 1.2 and, more preferably, between 0.2 and 1.0 μm. The grain size can be measuredly various methods which are known in the art. As for the representative method, reference can be made to the methods disclosed on pages 94 through 122 in "A.S.T.M.. Symposium on Microscopy" (1955) and to "The Theory of Photographic Process", fourth edition, edited by Mees and James and Published by Macmillan(1966) can be made.

The size of a grain can be measured by the use of projected area of the grain or an approximate value thereof. In the case when the grains consist essentially of a uniform shape, the size distribution of the grain can be expressed quite accurately in terms of the diameter or projection area thereof.

Distribution of the size of the silver halide grain used in the light-sensitive material of the present invention may be either so-called poly-dispersion or mono-dispersion. Preferably, however, mono-disperse silver halide grains, of which coefficient of variation is 0.22 or less and, more preferably, 0.15 or less, is used. Herein the term "coefficient of variation" is defined in the following equation.

Coefficient of Variation =S/R, wherein S stands for standard deviation of the grain size distribution and R stands for the average grain size.

Herein the term "grain size" means the diameter of the silver halide grain when it has a spherical shape and the diameter of a converted circle of the projected image thereof when the shape of the silver halide crystal is cubic or other than spherical.

As for the method or the apparatus employed in the preparation of the silver halide emulsion used in the present invention, various methods and apparatuses which are known in the art can be employed.

The silver halide emulsion used in the present invention may be any one which is obtained by acidic, neutral or ammoniacal process. The silver halide grains contained in the silver halide emulsion can be any one which has been grown up either at one time or stepwise. Further, the method of preparing seed grains and the method of growing thereof may be either the same or different.

As for the method of reacting a soluble silver salt with a soluble halide, either one of ordinary mixing method, reverse mixing method, simultaneous mixing method and any combination thereof may be employed, however, the simultaneous mixing method is preferable. Further, as a form of the simultaneous mixing method, a so-called "pAg-controlled double-jet mixing method" disclosed in Japanese Patent O.P.I. Publication No. 54-48521(1979) may also be employed.

Further, an apparatus for supplying the aqueous silver solution and the aqueous halide solution from an adding device arranged inside the reaction solution disclosed in Japanese Patent O.P.I. Publication Nos. 57-92523(1982) and 57-92524(1982); an apparatus for adding the aqueous silver solution and the aqueous halide solution while continuously changing concentrations thereof as disclosed in German Patent OLS Publication No. 2,921,164 and an apparatus for forming silver halide grains disclosed in Japanese Patent Publication No. 56-501776(1981), in which silver halide grains are produced by taking out the reaction solution from the reaction vessel and maintaining the distances between the grains in the solution constant by condensing the solutions by ultrafiltration may also be employed.

Still further, if necessary a solvent of the silver halide such as thioether may also be used. Still further, other compounds such as a compound containing a mercapto group, a nitrogen-containing heterocyclic compound and a sensitizing dye may also be used by adding to the silver halide emulsion either at the time or after completion of the grain formation.

In order to subjecting the silver halide emulsion of the present invention to reduction sensitization, any conventionally known methods can be applied. For example, a method of adding a variety of reducing agents; a method of carrying out ripening at a high silver ion concentration and a method of carrying out ripening under high pH condition may be applied.

As for reducing agents used in the reduction sensitization of the silver halide emulsion of the present invention, for example, a stannous salt such as stannous chloride; a borate such as tri-t-butylamine-borane; sulfites such as sodium sulfite, and potassium sulfite; reductions such as ascorbic acid and thiourea dioxide can be mentioned. Among these compounds, as the compounds which are preferably applied in the present invention, thiourea dioxide, ascorbic acid and derivatives thereof and a sulfite can be mentioned. This method is more advantageous than the method of carrying out reduction sensitization while controlling silver ion concentration or pH of the silver halide emulsion in the light of reproduction.

Reduction sensitization may be carried out either after dissolving these reducing agents in a solvent such as water or alcohol and adding them to the silver halide emulsion, or they may be added at the time of grain generation and the reduction sensitization is carried out at the same time of the grain formation.

Adding amounts of these reducing agents may be varied in accordance with various conditions such as, pH and silver ion concentration of the silver halide emulsion and, generally, $10^{-7}$ to $10^{-2}$ per mol of silver halide is preferable.

A small amount of oxidizing agent may be used in order to modify reduction sensitization specks or to deactivate the remaining reducing agent. As for such compound used for this purpose, for example, potassium ferric(III) cyanide, succinicimido bromide, p-quinone, potassium perchloride and hydrogen peroxide can be mentioned.

The silver halide emulsion used in the present invention can be subjected to other sensitization such as sensitization with a gold compound or a calcogenide compound in addition to the reduction sensitization.

As the calcogenide sensitizing agent applicable to the silver halide emulsion of the present invention, for example, sulfur sensitizing agents, selenium sensitizing agents and tellurium sensitizing agents can be mentioned, however, the sulfur sensitizing agents are preferable. As for the sulfur sensitizing agent, for example, thiosulfate, allylthiocarbamide, thiourea, allylisothiocyanate, cystine, p-toluene sulfonate and rhodanine can be mentioned.

As for the gold sensitizing agent which is applicable to the silver halide emulsion of the present invention, for example, chloroauric acid, gold sulfide, gold thiosulfide and other gold complexes can be mentioned. As for ligands, for example, dimethylrhodanine, thiocyanic acid, mercaptotetrazole and mercaptotriazole can be mentioned. Amount of the gold compound to be employed may be varied depending upon various conditions such as nature of silver halide emulsion to be used, kind of compound to be used and ripening conditions, however, generally in the range between $1\times10^{-4}$ to $1\times10^{-8}$ mol per mol of silver halide and, more preferably between $1\times10^{-5}$ and $1\times10^{-8}$ mol per mol of silver halide.

In the silver halide emulsion used in the present invention, for the purpose of restricting fog which takes place during various steps of manufacturing the silver halide light-sensitive photographic material of the present invention or for reducing fluctuation of photographic properties thereof during storage, an anti-foggant and/or a stabilizer which are known in the art can be used. As for the specific compounds used for these purposes, for example, the compound represented by the general formula (II) disclosed in the lower column on page 7 of Japanese Patent O.P.I. Publication No. 2-146036(1990) can be mentioned. More specifically, those exemplified compounds (IIa-1) through (IIa-8), (IIb-1) through (IIb-7) disclosed on page 8 of the same reference and 1-(methoxyphenyl)-5-mercaptotetrazole can be mentioned. These compounds may be added to the silver halide emulsion of the present invention in accordance with its purpose of addition during various manufacturing steps of the silver halide light-sensitive photographic material of the present invention, including, for example, a step of preparing silver halide grains, a step of chemical sensitization, at the time of completion of the chemical sensitization, a step of preparing coating solutions, etc. In the case where the chemical ripening is carried out in the presence of these compounds, they are preferably used within a range between $1\times10^{-5}$ and $1\times10^{-4}$ mol a mol of silver halide. When they are added at the completion of the chemical ripening, a quantity within a range between $1\times10^{-6}$ and $1\times10^{-2}$ mol a mol of silver halide is preferable and within a range between $1\times10^{-5}$ and $5\times10^{-3}$ mol a mol of silver halide is more preferable. In the case where they are added to the silver halide emulsion layer in the step of preparing coating solutions, within a range between $1\times10^{-6}$ and $1\times10^{-1}$ and, more advantageously, $1\times10^{-5}$ and $1\times10^{-2}$ mol a mol of silver halide is preferable. Further in the case where they are added to a layer other than silver halide emulsion layer, they are preferably added so that the amount in the layer to be within the range between $1\times10^{-9}$ and $1\times10^{-3}$ mol.

When the silver halide light-sensitive photographic material of the present invention is used for a light-sensitive color photographic material, it comprises a silver halide emulsion layer which is spectrally sensitized to a specific wavelength region between 400nm and 900 nm together with a yellow dye-forming coupler, a magenta dye-forming coupler and/or a cyan dye-forming coupler. Said silver halide emulsion usually contains one, or two or more kinds of optical sensitizing dyes in combination.

As for the spectral sensitizing dyes used in the silver halide emulsion of the present invention, any compounds known in the art can be used. For example, as blue-sensitive spectral sensitizing dye, for example, exemplified compounds BS-1 through BS-8 disclosed on pages 108 and 109 of Japanese Patent O.P.I. Publication No. 3-251840(1991) can be used either singly or in combination. As green-sensitive spectral sensitizing dyes, for example, exemplified compounds GS-1 through GS-5 disclosed on page 110 of the same reference may preferably be used. Further as red-sensitive spectral sensitizing dyes, for example, exemplified compounds RS-1 through RS-8 disclosed on pages 111 and 112 of the same reference may preferably be used. When the silver halide light-sensitive photographic material of the present invention is exposed to light by the use of a printer, in which a semiconductor laser light-emitting device is installed, it is required that a spectral sensitizing dye which is sensitive to infra-red light is used, and as for such infrared-sensitive sensitizing dyes, for example, exemplified compounds IRS-1 through IRS-11 disclosed on pages 12 through 14 of Japanese Patent O.P.I. Publication No. 3-73619(1991) can preferably be used. Moreover, it is preferable that the so-called exemplified "super-sensitizing agents" SS-1 through SS-11 disclosed on pages 14 and 15 of Japanese Patent of the same reference can be used in combination with these compounds.

In the silver halide light-sensitive photographic material of the present invention, for the purpose of preventing irradiation or halation, it is possible to use a dye or dyes having spectral absorption in the various spectral wavelength regions. For this purpose any compounds known in the art may be employed and, especially, as for the dyes which have absorption in the visual wavelength region, exemplified dyes AI-1 through AI-11disclosed on pages 117 and 118 of Japanese Patent O.P.I. Publication No. 2-51124(1990) may preferably be used and as infrared ray-absorbing dyes, compounds represented by the general formula (I), (II) or (III) in the left-down column on page 2 of Japanese Patent O.P.I. Publication No. 1-280750(1989) can preferably be used for their favorable spectral absorption property, reduced advertent influence on the photographic properties of the silver halide emulsion and reduced color staining due to remaining color. As specific examples of the preferable compounds, for example, exemplified compounds (1) through (45) disclosed in the left-down column on page 3 through left-down column on page 5 of the same reference can be mentioned.

As for the dye-forming coupler used in the silver halide light-sensitive photographic material of the present invention, any compounds which are capable of producing a coupling product having an absorption maximum in the wavelength region longer than 340 nm, upon reaction with an oxidation product of a color developing agent can be used.

As the representative compounds, for example, a yellow dye-forming coupler which has an absorption maximum in the wavelength region between 350 and 500 nm, a magenta dye-forming coupler which has an absorption maximum in the wavelength region between 500 and 600 nm and a cyan dye-forming coupler which has an absorption maximum in the wavelength region between 600 and 700 nm are representative.

As for the yellow dye-forming coupler which can preferably be applied in the silver halide light-sensitive photographic material of the present invention, for example, the compound represented by the general formula (Y-I) disclosed on page 8 of Japanese Patent O.P.I. Publication No. 4-114154(1992) can be mentioned. To be more specific, those compounds YC-1 through YC-9 disclosed on pages 9 through 11 of the same reference can be mentioned. Among these, compounds YC-8 and YC-9 are preferable in the light of their favorable reproducibility of yellow color.

As for the cyan dye-forming coupler which can preferably be applied in the silver halide light-sensitive photographic material of the present invention, for example, the compound represented by the general formula (C-I) and (C-II) disclosed on page 17 of Japanese Patent O.P.I. Publication No. 4-114154(1992) can be mentioned. To be more specific, those compounds CC-1 through CC-9 disclosed on pages 18 through 21 of the same reference can be mentioned.

In the case when a oil-in-water type emulsification method is applied in order to incorporate the dye-forming coupler in the silver halide light-sensitive photographic material of the present invention, the dye-forming coupler is first dissolved in a water-insoluble high boiling point organic solvent having boiling point of not lower than 150° C., together with, if necessary, a low boiling-point organic solvent and/or a water-miscible organic solvent and, then, dispersed and emulsified in an aqueous solution containing a hydrophilic binder such as gelatin together with a surface active agent such as a betaine-type surface active agent or other type surfactant. As for dispersion means, for example, a stirrer, a homogenizer, a colloid mill, a flow-jet mixer and an ultrasonic mixer can be used. Herein, during or after dispersion there may be a step of removing the low boiling-point organic solvent.

For the purpose of shifting the absorption wavelength of the produced dye, compounds such as compound (d-11) disclosed on page 33 of Japanese Patent O.P.I. Publication No. 4-114154(1992) and compound (A'-1) disclosed on page 35 of the same reference can be used. Further beside these compounds mentioned above, a fluorescent dye-releasing compound disclosed in U.S. Pat. No. 4,774,181 may also be used.

Although there is no specific limits concerning the quantity of the dye-forming coupler to be employed if sufficiently high density can be obtained, however, it is usually used within a range between $1\times10^{-3}$ and 5 mols and, more preferably, between $1\times10^{-2}$ and 1 mol a mol of silver halide.

In the silver halide light-sensitive photographic material of the present invention, it is usually advantageous to use gelatin as a binder, however, if necessary, it is possible to use other hydrophilic colloid such as other gelatin, a gelatin derivative, a graft polymer formed of gelatin and other polymeric compound, a protein other than gelatin, a sugar derivative, a cellullose derivative and a synthetic hydrophilic polymer may also be used.

The total amount of gelatin preferably used as a binder is generally not more than 10.0 g/m$^2$, and in order for the effect of the present invention to be exerted distinctively, it is not more than 7.0 g/m$^2$. There is no specific lower limit, however, in view of physical and photographic properties not less than 3.0 g/m$^2$ is generally preferable.

As a reflective support used in the present invention may be optional and paper laminated with polyethylene containing a white pigment, baryta paper, vinyl chloride sheet, polypropylene containing a white pigment and polyethyleneterephthalate support may also be used.

Among these, a support laminated with a polyolefin resin containing a white pigment is preferable.

As for the white pigment used for the reflective support of the present invention inorganic and/or organic white pigment can be used. Preferably, however, inorganic white pigment is preferable. For example, sulfate of an alkaline earth metal such as barium sulfate; a carbonate of an alkaline earth metal such as calcium carbonate; silicates such as fine powder of silica and synthetic silicate; calsium silicate, alumina, almina hydride, titanium oxide, zinc oxide talc and clay can be mentioned. Preferable white pigments are barium sulfate and titanium oxide.

The amount of the white pigment to be incorporated in the water-resistant resin layer provided on the surface of the reflective support used in the present invention is preferably in an amount greater than 10% by weight, more preferably greater than 12% by weight and, most advantageously greater than 15% by weight. The degree of dispersion of the white pigment in the water-resistant resin layer on the paper support used in the present invention can be measured by the method disclosed in Japanese Patent O.P.I. Publication No. 2-28640(1990). The degree of dispersion of the white pigment measured according to this method is preferably not greater than 0.20 as the coefficient of variation described therein, more preferably not greater than 0.15 and, most advantageously, not greater than 0.10.

The silver halide emulsion of the present invention may be coated on the support either directly or through one or more of subbing layers, after, if necessary, the surface of the support is subjected to various treatments such as corona discharge, irradiation with UV or flame, etc. in order to improve adhesion property to the layer to be provided thereon, anti-static property, size stability, anti-abrasion property, hardness, anti-halation property and/or other physical properties of the support.

Upon preparation of a light-sensitive material using the silver halide emulsion, a viscosity-increasing agent may be used in order to improve coating performance. As for the coating method preferably applied to the preparation of the silver halide light-sensitive material of the present invention, the extrusion coating method and the curtain coating method, in which two or more kinds of layer can be coated simultaneously, are especially preferable.

As the color developing agent used in the development process of the silver halide light-sensitive photographic material of the present invention, aminophenol-type or p-phenylenediamine-type compounds, which are popularly used in the various color photographic processes are used. Particularly, aromatic primary amine-type color developing agents are preferable.

As for the aromatic primary amine color developing agent, the following compounds are representative.

(1) N,N-dimethyl-p-phenylenediamine hydrochloride (2) N-methyl-p-phenylenediamine hydrochloride (3) 2-Amino-5-(N-ethyl-N-dodecylamino)toluene (4) N-ethyl-N-(β-methanesulfonamidoethyl)-3-methyl-4-aminoaniline sulfate (5) N-ethyl-N-(β-hydroxyethyl)-3-methyl-4-aminoaniline sulfate (6) 4-Amino-3-methyl-N,N-diethylaniline (7) 4-Amino-N-(β-methoxyethyl)-N-ethyl-3-methylaniline p-toluene sulfonate (8) 4-Amino-N-ethyl-N-(γ-hydroxypropyl)-3-methylaniline p-toluene sulfonate These color developing agents are preferably used at a quantity between $1\times10^{-3}$ and $2\times10^{-1}$ and, more preferably, between $5\times10^{-3}$ and $2\times10^{-1}$ mol per liter of color developing solution.

In the above-mentioned color developing solution, various additives, which are known in the art as ingredients for the color developing solution can be used. Such additives include, for example, an alkali agent which usually functions as a pH buffer, a chloride ion, a development inhibitor such as benztriazole, a stabilizer and a chelating agent.

As for the alkaline agent used for the developing solution used for the silver halide light-sensitive material of the present invention, for example, potassium carbonate, potassium borate and trisodium phosphate can be mentioned. For the purpose of adjusting pH of the solution, for example, sodium hydroxide and potassium hydroxide may be used. The pH value of the color developing solution is usually in a range between 9 and 12 and, more preferably, between 9.5 and 11.

For the purpose of development inhibition, a halide ion may often be used, however in the image formation process according to the present invention, since it is necessary to complete development within a short period of time, the halide ion is mainly employed and, for example, potassium chloride and sodium chloride are used. The amount of the halide ion to be used is not less than $3.0\times10^{-2}$ and, more preferably, in the range between $4.0\times10^{-2}$ and $5.0\times10^{-1}$ mol per liter of the color developing solution. Bromide ion may be use at an optional quantity as far as it does not jeopardise the effect of the present invention, however since it has relatively large development inhibiting effect, so that a quantity smaller than $1.0\times10^{-3}$ and, especially, smaller than $5.0\times10^{-4}$ is preferable.

As for the preservative, for example, a hydroxylamine derivatives (excluding hydroxylamine), hydroxamic acids, hydrazines, hydrazideaminoketones, sugars, monoamines, diamines, polyamines, quarternary ammonium salts, nitroxy radicals, alcohols, oximes, diamide compounds and fused cyclic amine compounds are mentioned as especially preferable organic preservatives. Among these compounds, dialkyl-substituted hydroxylamines such as diethylhydroxylamine and alkanolamines such as triethanolamine are preferably used.

As for the chelating agent used in the color developing solution used in the present invention, for example, compounds such as aminopolycarboxylic acid, aminopolyphosphonic acid, alkylphosphonic acid and phosphonocarboxylic acid may preferably be used. Especially, ethylenediamineteraacetic acid, nitrilotriacetic acid, diethylenetriaminepentaacetic acid and 1-hyderoxyethylidene-1,1-diphosphnic acid are preferably used.

Temperature for the color development is usually not lower than 15° C. and, generally at a temperature between 20 and 50° C. Moreover, in the case of rapid process development is carried out at a temperature higher than 30° C.

Time required for the color development process is generally ten seconds to four minutes, however, according to the present invention, it is preferably be carried out within a period between five and 45 seconds and when rapid process is required, between five and 25 seconds and, more preferably, between five and 15 seconds.

Further, when the color development process is carried out continuously, while continuously replenishing the color developing solution, it is preferable that substantially no overflow of the color developing solution occurs during the process, and, more specifically, preferable replenishing amount of the color developing solution is between 20 and 60 ml per square meter of the light-sensitive material.

The silver halide light-sensitive photographic material of the present invention undergoes, after color development process, a bleaching process and a fixing process. The bleaching process and the fixing process may be carried out simultaneously. A washing or a rinsing process is usually carried out After the fixing process. Moreover in place of the washing process a stabilizing process may be made. As for device carrying out the color development of the silver halide light-sensitive photographic material of the present invention, either so-called a roller-transport type, in which the light-sensitive material is transported by rollers provided in the processing bath or an endless belt-transport system, in which the light-sensitive material is fixed to an endless belt and transported, may be applied.

Particularly, it may be a system in which the processing bath is formed in the shape of a slit and the light-sensitive material is transported, while supplying the processing solution to the processing bath.

EXAMPLES

Below, the present invention is further explained with reference to working examples, however, the scope of the present invention is not limited to them.

EXAMPLE 1

Preparation of silver halide emulsion

Three kinds of silver halide emulsions as shown below were prepared.

TABLE 1

| Emulsion No. | AgCl (mol %) | AgBr (mol %) | Average Grain Size (μm) | Chemical Sensitizer | Spectral Sensitizing Dye |
|---|---|---|---|---|---|
| Em-1 | 99.5 | 0.5 | 0.67 | Sodium | SD-1* |
| EM-1 | 99.5 | 0.5 | 0.46 | thiosulfate and | SD-2** |
| Em-1 | 99.5 | 0.5 | 0.43 | gold chloride | SD-3*** |

*0.9 mmol per mol of silver halide was added.
**0.7 mmol per mol of silver halide was added,
***0.2 mmol per mol of silver halide was added.

To the respective silver halide emulsions, STB-1 of $2\times10^{-4}$ mol per mol of silver halide was added.

Preparation of silver halide light-sensitive color photographic material

A multi-layer light-sensitive color photographic material 101(comparative sample) was prepared by coating respective layers, of which components are given below, on a support one of which support is laminated with polyethylene and the other surface of which support was laminated with polyethylene containing titanium oxide.

Coating solution of the first layer

To 60 ml of ethyl acetate a mixture of 26.7 g of a yellow dye-forming coupler (Y-1), 0.67 g of an anti-staining agent (HQ-1), 10.0 g and 6.7 g of a dye image-stabilizers (ST-1) and (ST-2) and 6.7 g of high boiling-point solvent (DNP) were added and they were dissolved therein. This solution was then added to 200 ml of 10% by weight of aqueous gelatin solution containing 10 ml of 10% by weight of sodium alkylnaphthalene sulfonate and dispersed therein by the use of a homogenizer, to prepare a dispersion containing a yellow dye-image forming coupler. This dispersion was then mixed with a blue-sensitive silver chlorobromide emulsion (Em-1; 10 g as converted into silver) and an aqueous gelatin solution, to prepare a coating solution for the first layer.

Coating solutions for the second through the seventh layers were prepared in the similar manner.

Moreover, as a hardener, (H-1) and (H-2) were added to the second and the fourth layers and the seventh layer, respectively.

As the coating aids, (SU-1) and (SU-2), which are surface active agents, were added to adjust the surface tension of the coating solution.

TABLE 2

| Layer | Structure | Amount ($g/m^2$) |
|---|---|---|
| Seventh Layer (protective Layer) | Gelatin | 1.00 |
| Sixth Layer (UV-Ray Absorbing Layer) | Gelatin | 0.40 |
| | UV-Ray Absorbent (HUV-1) | 1* |
| | UV-Ray Absorbent (UV-2) | 0.04 |
| | UV-Ray Absorbent (UV-3) | 0.16 |
| | Anti-Staining Agent (HQ-1) | 0.01 |
| | DNP | 0.20 |
| | PVP | 0.03 |
| Fifth Layer (Red-Sensitive Layer) | Gelatin | 1.30 |
| | Red-Sensitive Silver Chlorobromide Emulsion (Em-1) | 0.21 |
| | Cyan Dye-Forming Coupler (C-1) | 0.26 |
| | Cyan Dye-Forming Coupler (C-2) | 0.09 |
| | Dye Image-Stabilizer (ST-1) | 0.20 |
| | Anti-staining Agent (HQ-1) | 0.01 |
| | HBS-1H | 0.20 |
| | DOP (Dioctylphthalate) | 0.20 |
| Fourth Layer | Gelatin | 0.94 |

TABLE 2-continued

| Layer | Structure | Amount ($g/m^2$) |
|---|---|---|
| (UV-Ray Absorbing Layer) Gelatin | UV Absorbent (HUV-1) | 2* |
| | UV Absorbent (UV-2) | 0.09 |
| | UV Absorbent (UV-3) | 0.38 |
| | Anti-Staining Agent (HQ-1) | 0.03 |
| | DNP | 0.40 |
| Third Layer (Green-Sensitive Layer) | Gelatin | 1.40 |
| | Green-Sensitive Silver Chlorobromide Emulsion (Em-2) | 0.17 |
| | Magenta Dye-Forming Coupler (M-7) | 1* |
| | Dye Image Stabilizer (ST-3) | 0.10 |
| | Dye Image Stabilizer (ST-4) | 0.10 |
| | Anti-Staining Agent (AIM-1) | 0.01 |
| | DOP | 1* |
| Second Layer (Intermediate Layer) | Gelatin | 1.20 |
| | Anti-Staining Agent (HQ-2) | 0.12 |
| | DIDP | 0.15 |
| First Layer (Blue-Sensitive Layer) | Gelatin | 1.20 |
| | Blue-Sensitive Silver Chlorobromide Emulsion (Em-3) | 0.26 |
| | Yellow Dye-Forming Coupler (Y-1) | 0.80 |
| | Dye Image Stabilizer (ST-1) | 0.30 |
| | Dye Image Stabilizer (ST-2) | 0.20 |
| | Anti-Staining Agent (HQ-1) | 0.02 |
| | DNP | 0.20 |
| Support | Paper laminated with polyethylene | |

Note:) Added amount of silver halide emulsion was shown in terms of that converted into silver
*: m $mol/m^2$ Below, chemical structures of the compounds used in Tables 2 are given.

SD-1
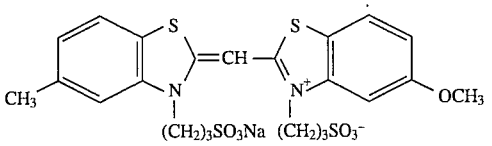
SD-2
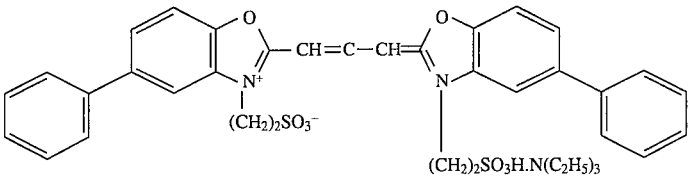
SD-3
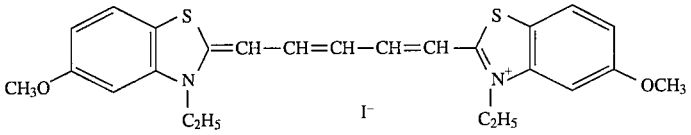
STB-1
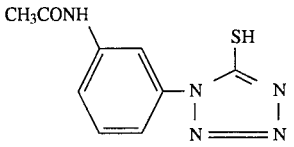
ST-1
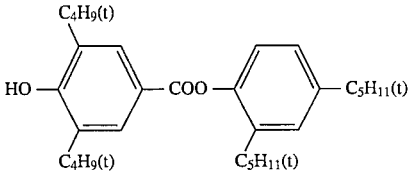
ST-2
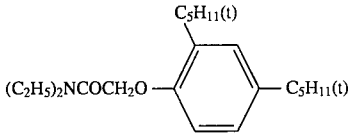
HBS-1
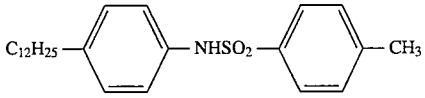
DOP:
Dioctylphthalate
DNP:
Dinonylphthalate
DIDP:
Diisodecylphthalate
PVP:
Polyvinylpyrrolidone
SU-1
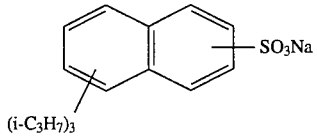
SU-2
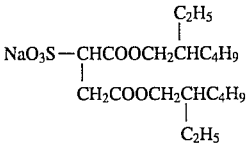
H-1
$C(CH_2SO_2CH{=}CH_2)_4$ -continued
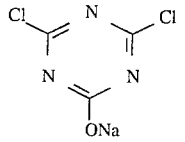
H-2
(solid at a ordinal temperature; melting point: 80-90° C.)
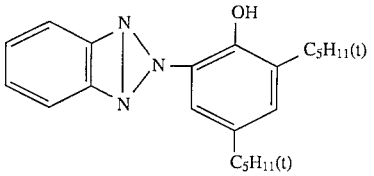
HUV-1
(solid at a ordinal temperature; melting point: 75-90° C.)
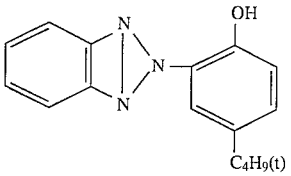
HUV-2
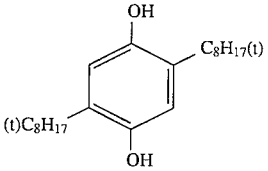
HQ-1
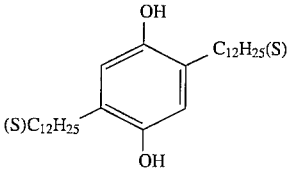
HQ-2
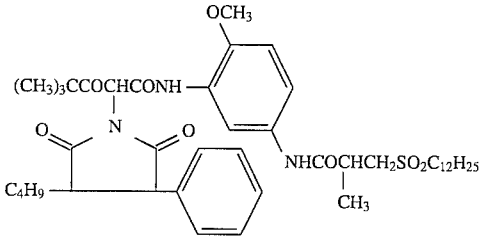
Y-1
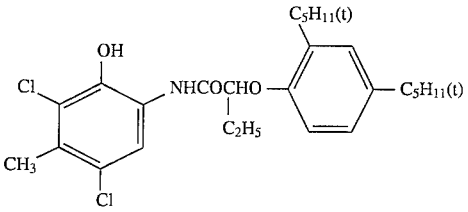
C-1
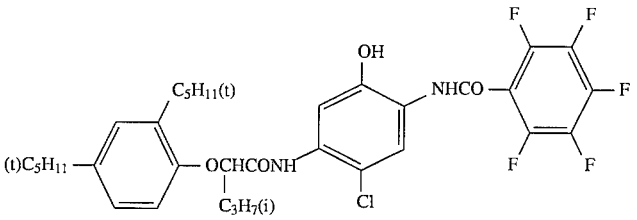
C-2

-continued

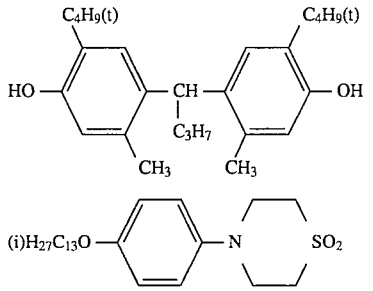

ST-3

ST-4

As mentioned above, Sample 101 was prepared.

Samples 102 through 135 were prepared in the same manner as Sample 101, provided that in these samples the magenta dye-forming coupler and DOP dioctylphthalate used in the third layer of Sample 101 were replaced by the magenta coupler and HBS shown in Table 4. (Added amount of the compounds were not changed).

Thus prepared samples were divided into two groups and one group of the samples were subjected to exposure to green light through an optical wedge and the other group of samples were subjected to uniform exposure, and, then, after all these samples were subjected to continuous running color processing consisting of the following processing steps shown below until the time when three times volume as much as that of the tank of the color developing solution was replenished, the following evaluation was made.

| Processing Step | Temperature (°C.) | Time (sec) | Replenishiner |
|---|---|---|---|
| color Development | 35.0 ± 0.3 | 45" | 120 ml |
| Bleach-Fixing | 35.0 ± 0.5 | 45" | 51 ml |
| Stabilization (three baths cascade) | 30–34 | 90" | 250 ml |
| Drying | 60–80 | 30" | |

Compositions of the respective processing solutions are shown below: The replenishing amount is expressed in terms of the amount in ml per square meter of the light-sensitive material. Further, the stabilization process was carried out with three tanks by counter-current method(tank 3 to tank 1).

(Processing Step A)

| Color Developing Solution | Tank Solution | Replenisher |
|---|---|---|
| Water | 800 ml | 800 ml |
| Triethanolamine | 10 g | 18 g |
| N,N-diethylhydroxylamine | 5 g | 9 g |
| potassium chloride | 2.0 g | |
| 1-hydroxyethylidene-1,1-diphosphonic acid | 1.0 g | 1.8 g |
| N-ethyl-N-β-methanesulfonamidoethyl-3-methyl-4-aminoaniline sulfate | 5.4 g | 8.2 g |
| potassium carbonate | 27 g | 27 g |

Add water to make the total volume 1000 ml, and adjust the pH of the solution at 10.10 (tank solution) and 10.60 (replenisher), respectively.

Bleach-fixing solution
(compositions of the solutions for the tank and replenisher are the same.)

| | |
|---|---|
| Ferric ammonium ethylenediaminetetraacetate dihydride | 53 g |
| Ethylenediaminetetraacetic acid | 3 g |
| Ammonium thiosulfate (70% aqqueous solution) | 123 g |
| Ammonium thiosulfite (40% aqueous solution) | 51 g |

Add water to make the total volume 1000 ml and adjust pH of the solution with ammoniacal water or glacial acetic acid at 5.4.

Stabilizing Solution
(composition of the solutions for the tank and replenisher are same.)

| | |
|---|---|
| o-Phenylphenol | 0.1 g |
| Ubitex (Chiba geigy) | 1.0 g |
| Zinc sulfate hexahydride | 0.1 g |
| 1-hydroxyethylidene-1,1-diphosphonic acid | 3.0 g |
| Ethylenediaminetetracetic acid | 1.5 g |

Add water to make the total volume 1000 ml and adjust pH with ammoniacal water or glacial acetic acid at 7.8

Method of Evaluation

Evaluation with respect to fastness against light was conducted by allowing the above-mentioned processed samples to stand under the exposure of sun light for ten weeks and measuring residual ratio of the reflective green densities at the portion where the density is 0.8 and the amount of increase in the reflective blue density (Db: Light Y-stain) at an unexposed portion of the samples.

Evaluation with respect to sweating of the samples was conducted by visual observation of the above-mentioned Samples after they were allowed to stand under conditions of 85° C. and 60% R.H. for five weeks.

<Criteria>

E: Excellent: No sweating observed

G: Good: A slight sweating observed without any commercial value

F: Fair: Sweating observed, which can be a commercial problem

P: Poor: Considerable sweating observed and is commercially problematic.

Moreover, evaluation of clearness of the image was made by visual observation by twenty standard observers using five different pictures of the objects given below.

<Objects>

Human figure(under sun-light)

Human figure(under fluorescent light)

Human figure(flash exposure)

Landscape a night view

<Evaluation>

E: Excellent: More than 80% of samples are judged to be clear

G: Good: More than 60% of samples are judged to be clear

F: Fair: More than 40% of samples are judged to be clear

P: poor: More than 20% of samples are judged to be clear

TABLE 3

| Sample No. | Third Layer Magenta Coupler | Third Layer HBS | 4th and 6th Layers UV Absorbent | Ratio of Residual Dye | Dye-Forming Efficiency | ΔDb | Sweating | Clearness | Remarks |
|---|---|---|---|---|---|---|---|---|---|
| 101 | M-7 | DOP | HUV-1 | 44 | 2.00 | 0.05 | ○ | Δ | Comp. |
| 102 | M-7 | DOP | UV-14 | 45 | 2.05 | 0.15 | ○ | x | Comp. |
| 103 | M-7 | TCP* | HUV-1 | 48 | 1.84 | 0.13 | ○ | Δ | Comp. |
| 104 | M-7 | TCP* | UV-14 | 44 | 1.86 | 0.19 | ○ | Δ | Comp. |
| 105 | M-7 | ** | UV-14 | 38 | 1.91 | 0.15 | Δ | ○ | Comp. |
| 106 | M-7 | II-5 | HUV-1 | 54 | 1.91 | 0.15 | x | ○ | Comp. |
| 107 | M-7 | III-12 | HUV-1 | 53 | 2.02 | 0.15 | x | ○ | Comp. |
| 108 | M-7 | IV-2 | HUV-1 | 54 | 2.01 | 0.17 | x | Δ | Comp. |
| 109 | M-7 | V-3 | HUV-1 | 54 | 2.03 | 0.14 | x | ○ | Comp. |
| 110 | M-7 | VII-5 | HUV-1 | 54 | 2.03 | 0.16 | x | ○ | Comp. |
| 111 | M-7 | II-5 | HUV-2 | 52 | 1.90 | 0.19 | Δ | Δ | Comp. |
| 112 | M-7 | III-12 | HUV-2 | 54 | 2.00 | 0.18 | x | Δ | Comp. |
| 113 | M-7 | II-5 | UV-14 | 78 | 2.25 | 0.05 | ◎ | ◎ | Inv. |
| 114 | M-7 | III-12 | UV-14 | 67 | 2.36 | 0.04 | ○ | ◎ | Inv. |
| 115 | M-7 | IV-2 | UV-14 | 70 | 2.24 | 0.05 | ○ | ◎ | Inv. |
| 116 | M-7 | V-3 | UV-14 | 73 | 2.26 | 0.06 | ○ | ○ | Inv. |
| 117 | M-7 | VII-5 | UV-14 | 75 | 2.22 | 0.05 | ◎ | ○ | Inv. |
| 118 | M-7 | II-7 | UV-14 | 76 | 2.21 | 0.04 | ○ | ○ | Inv. |
| 119 | M-7 | II-11 | UV-14 | 71 | 2.30 | 0.05 | ○ | ◎ | Inv. |
| 120 | M-7 | II-22 | UV-14 | 72 | 2.24 | 0.03 | ○ | ◎ | Inv. |
| 121 | M-7 | III-4 | UV-14 | 72 | 2.23 | 0.07 | ○ | ◎ | Inv. |
| 122 | M-7 | IV-5 | UV-14 | 73 | 2.21 | 0.04 | ○ | ○ | Inv. |
| 123 | M-7 | IA-3 | UV-14 | 62 | 2.20 | 0.04 | ○ | ○ | Inv. |
| 124 | M-7 | IA-6 | UV-14 | 62 | 2.19 | 0.05 | ○ | ○ | Inv. |
| 125 | M-7 | VI-3 | UV-14 | 64 | 2.22 | 0.04 | ◎ | ○ | Inv. |
| 126 | M-7 | VI-16 | UV-14 | 63 | 2.21 | 0.05 | ○ | ○ | Inv. |
| 127 | M-7 | VII-5 | UV-14 | 68 | 2.20 | 0.04 | ○ | ○ | Inv. |
| 128 | M-7 | VII-12 | UV-14 | 64 | 2.23 | 0.05 | ○ | ○ | Inv. |
| 129 | M-7 | VIII-5 | UV-14 | 67 | 2.23 | 0.04 | ○ | ◎ | Inv. |
| 130 | M-7 | VIII-12 | UV-14 | 66 | 2.24 | 0.05 | ○ | ◎ | Inv. |
| 131 | M-7 | IX-4 | UV-14 | 65 | 2.25 | 0.04 | ○ | ◎ | Inv. |
| 132 | M-7 | IX-12 | UV-14 | 68 | 2.23 | 0.04 | ○ | ◎ | Inv. |
| 133 | M-7 | X-6 | UV-14 | 67 | 2.22 | 0.05 | ◎ | ○ | Inv. |
| 134 | M-7 | X-10 | UV-14 | 65 | 2.19 | 0.04 | ○ | ○ | Inv. |
| 135 | M-7 | XI-4 | UV-14 | 66 | 2.20 | 0.05 | ◎ | ○ | Inv. |

Comp.: Comparison
Inv.: Invention
*): Tricresylphosphate
**): Comparison, HBS-1: $C_{12}H_{25}OH$ It is obvious from the results shown in Table 4 that when the liquid-type ultraviolet-ray (UV) absorbent and the polyhydric alcohol according to the present invention are used in combination, improvements in the ratio of the residual dye, dye-forming efficiency, occurrence of stain and sweating. Further surprisingly, it is understood that there is also distinguishable improvement in the clearness of the dye image when the polyhydric alcohol and the liquid-type UV absorbent are used in combination.

Contrary thereto, when DOP or TCP popularly used in the art is used instead of the polyhydric alcohol according to the present invention, distinguishable deterioration in the ratio of residual dye, dye-forming efficiency and clearness of the dye image are observed. Also there was a slight deterioration in the sweating. Moreover when Comparative HBS-1, which is a monohydric alcohol is used, it was found that the effects of the present invention are even inferior to the case where DOP or TCP is used.

Further, the effects of the present invention was remarkable when the total processing time from color development to drying is carried out within four minutes.

EXAMPLE 2

Samples Nos. 201 through 252 were prepared in the same manner as Sample No. 1 in Example 1, provided that 1 mg/m$^2$ each of HBS and magenta dye-forming coupler as shown in Tables 5 and 6 were incorporated in the third layer and 2 mmol/m$^2$ and 1 mmol/m$^2$ of UV absorbent was incorporated in the fourth and the sixth layers, respectively.

In this example, as regards HBS, as sown in Tables 5 and 6, 0.5 mmol/m$^2$ each of HBS-I and HBS-II, so that 1 mmol/m$^2$ in total was added.

TABLE 4

| Sample No. | Third Layer: Magenta Coupler | Third Layer: HBS-I | Third Layer: HBS-II | 4th and 6th Layers: UV Absorbent | Ratio of Residual Dye | Dye-Forming Efficiency | ΔDb | Sweating | Clearness | Remarks |
|---|---|---|---|---|---|---|---|---|---|---|
| 201 | M-7 | DOP | TCP | HUV-1 | 44 | 1.90 | 0.06 | ○ | Δ | Comp. |
| 202 | M-7 | DOP | TCP | UV-25 | 45 | 1.94 | 0.15 | ○ | x | Comp. |
| 203 | M-7 | * | DOP | UV-25 | 38 | 1.82 | 0.15 | Δ | ○ | Comp. |
| 204 | M-7 | II-5 | DOP | HUV-1 | 53 | 1.82 | 0.15 | x | ○ | Comp. |
| 205 | M-7 | III-12 | DOP | HUV-1 | 52 | 1.92 | 0.15 | x | ○ | Comp. |
| 206 | M-7 | IV-2 | DOP | HUV-1 | 53 | 1.91 | 0.16 | x | Δ | Comp. |
| 207 | M-7 | V-3 | DOP | HUV-1 | 53 | 1.93 | 0.14 | x | ○ | Comp. |
| 208 | M-7 | VII-5 | DOP | HUV-1 | 53 | 1.93 | 0.15 | x | ○ | Comp. |
| 209 | M-7 | II-5 | DOP | HUV-2 | 41 | 1.71 | 0.14 | Δ | x | Comp. |
| 210 | M-7 | IX-4 | TCP | HUV-2 | 43 | 1.73 | 0.15 | x | x | Comp. |
| 211 | M-7 | VIII-5 | DOP | UV-25 | 64 | 2.10 | 0.05 | ○ | ⊙ | Inv. |
| 212 | M-7 | IX-4 | DOP | UV-25 | 62 | 2.12 | 0.05 | ○ | ⊙ | Inv. |
| 213 | M-7 | IX-12 | DOP | UV-25 | 65 | 2.10 | 0.05 | ○ | ⊙ | Inv. |
| 214 | M-7 | X-10 | DOP | UV-25 | 62 | 2.07 | 0.05 | ○ | ○ | Inv. |
| 215 | M-7 | IX-4 | DOP | UV-25 | 63 | 2.08 | 0.06 | ⊙ | ○ | Inv. |
| 216 | M-7 | * | TCP | UV-25 | 43 | 1.75 | 0.11 | Δ | Δ | Comp. |
| 217 | M-7 | II-5 | TCP | UV-25 | 55 | 1.79 | 0.04 | ⊙ | ○ | Inv. |
| 218 | M-7 | III-12 | TCP | UV-25 | 56 | 1.68 | 0.05 | ○ | ○ | Inv. |
| 219 | M-7 | IV-2 | TCP | UV-25 | 51 | 1.68 | 0.04 | ⊙ | ⊙ | Inv. |
| 220 | M-7 | V-3 | TCP | UV-25 | 50 | 1.77 | 0.05 | ○ | ⊙ | Inv. |
| 221 | M-7 | VII-5 | TCP | UV-25 | 51 | 1.76 | 0.04 | ⊙ | ○ | Inv. |
| 222 | M-7 | VIII-5 | TCP | UV-25 | 51 | 1.78 | 0.06 | ○ | ○ | Inv. |
| 223 | M-7 | IX-4 | TCP | UV-25 | 51 | 1.78 | 0.05 | ⊙ | ⊙ | Inv. |
| 224 | M-7 | IX-12 | TCP | UV-25 | 61 | 1.93 | 0.04 | ○ | ⊙ | Inv. |
| 225 | M-7 | X-10 | TCP | UV-25 | 59 | 1.94 | 0.06 | ⊙ | ○ | Inv. |
| 226 | M-7 | VI-4 | TCP | UV-25 | 62 | 1.93 | 0.06 | ○ | ○ | Inv. |
| 227 | M-12 | DOP | TCP | HUV-1 | 51 | 1.90 | 0.05 | ○ | Δ | Comp. |
| 228 | M-12 | DOP | TCP | UV-25 | 54 | 1.91 | 0.15 | ○ | x | Comp. |
| 229 | M-12 | * | DOP | UV-25 | 45 | 1.89 | 0.15 | x | ○ | Comp. |
| 230 | M-12 | II-5 | DOP | HUV-1 | 70 | 2.04 | 0.15 | x | ○ | Comp. |
| 231 | M-12 | III-12 | DOP | HUV-1 | 71 | 1.90 | 0.15 | x | ○ | Comp. |
| 232 | M-12 | IV-2 | DOP | HUV-1 | 63 | 1.90 | 0.17 | Δ | x | Comp. |
| 233 | M-12 | V-3 | DOP | HUV-1 | 62 | 2.01 | 0.14 | x | ○ | Comp. |
| 234 | M-12 | VII-5 | DOP | HUV-1 | 63 | 2.00 | 0.16 | x | ○ | Comp. |
| 235 | M-12 | II-5 | DOP | HUV-2 | 44 | 1.88 | 0.14 | ○ | x | Comp. |
| 236 | M-12 | III-12 | TCP | HUV-2 | 42 | 1.91 | 0.15 | x | x | Comp. |
| 237 | M-12 | VIII-5 | DOP | UV-25 | 63 | 2.02 | 0.04 | ○ | ⊙ | Inv. |
| 238 | M-12 | IX-4 | DOP | UV-25 | 63 | 2.02 | 0.04 | ○ | ⊙ | Inv. |
| 239 | M-12 | IX-12 | DOP | UV-25 | 75 | 2.21 | 0.04 | ○ | ○ | Inv. |
| 240 | M-12 | X-10 | DOP | UV-25 | 73 | 2.23 | 0.04 | ○ | ⊙ | Inv. |
| 241 | M-12 | IX-4 | DOP | UV-25 | 76 | 2.21 | 0.05 | ○ | ⊙ | Inv. |
| 242 | M-12 | * | TCP | UV-25 | 44 | 1.90 | 0.11 | x | ○ | Comp. |
| 243 | M-12 | II-5 | TCP | UV-25 | 74 | 2.38 | 0.03 | ○ | ⊙ | Inv. |
| 244 | M-12 | III-12 | TCP | UV-25 | 52 | 2.03 | 0.05 | ○ | ⊙ | Inv. |
| 245 | M-12 | IV-2 | TCP | UV-25 | 53 | 2.07 | 0.03 | ○ | ○ | Inv. |
| 246 | M-12 | V-3 | TCP | UV-25 | 47 | 1.95 | 0.05 | ○ | ⊙ | Inv. |
| 247 | M-12 | VII-5 | TCP | UV-25 | 61 | 1.95 | 0.03 | ○ | ⊙ | Inv. |
| 248 | M-12 | VIII-5 | TCP | UV-25 | 60 | 2.05 | 0.06 | ○ | ⊙ | Inv. |
| 249 | M-12 | IX-4 | TCP | UV-25 | 61 | 2.04 | 0.05 | ○ | ○ | Inv. |
| 250 | M-12 | IX-12 | TCP | UV-25 | 61 | 2.05 | 0.03 | ○ | ⊙ | Inv. |
| 251 | M-12 | X-10 | TCP | UV-25 | 61 | 2.05 | 0.06 | ○ | ○ | Inv. |
| 252 | M-12 | VI-4 | TCP | UV-25 | 72 | 2.22 | 0.06 | ○ | ⊙ | Inv. |

*Comparative HBS-1
Comp: Comparison
Inv.: Invention

It is obvious from the results shown in Table 4 that when the liquid-type UV absorbent and the polyhydric alcohol according to the present invention are used in combination, and, further when DOP or TCP was used as HBS as shown Table 5, improvements in the ratio of the residual dye, dye-forming efficiency, occurrence of stain and sweating. Further surprisingly, it is understood that there is also significantly remarkable improvement in the clearness of the dye image when the polyhydric alcohol and the liquid-type UV absorbent are used in combination.

Further, the effects of the present invention was distinguishable when the total processing time from color development to drying is carried out within four minutes.

EXAMPLE 3

Samples Nos. 301 through 327 were prepared in the same manner as Sample No. 1 in Example 1, provided that in this example 1 mg/m$^2$ each of HBS and magenta dye-forming coupler as shown in Tables 7 were incorporated in the third layer and 2 mmol/m$^2$ and 1 mmol/m$^2$ of UV absorbent was incorporated in the fourth and the sixth layers, respectively.

TABLE 5

| Sample No. | Third Layer Magenta Coupler | Third Layer HBS | 4th and 6th Layers UV Absorbent | Ratio of Residual Dye | Dye-Forming Efficiency | ΔDb | Sweating | Clearness | Remarks |
|---|---|---|---|---|---|---|---|---|---|
| 301 | M-9 | DOP | HUV-1 | 44 | 2.05 | 0.05 | ○ | Δ | Comp. |
| 302 | M-9 | TCP | HUV-1 | 45 | 1.75 | 0.15 | ○ | x | Comp. |
| 303 | M-9 | * | HUV-1 | 48 | 1.88 | 0.13 | ○ | Δ | Comp. |
| 304 | M-9 | II-5 | HUV-1 | 50 | 2.07 | 0.19 | x | Δ | Comp. |
| 305 | M-9 | VII-5 | HUV-1 | 44 | 2.07 | 0.15 | x | ○ | Comp. |
| 306 | M-9 | DOP | UV-15 | 48 | 1.95 | 0.15 | ○ | Δ | Comp. |
| 307 | M-9 | TCP | UV-15 | 52 | 1.92 | 0.15 | Δ | ○ | Comp. |
| 308 | M-9 | * | UV-15 | 39 | 1.94 | 0.17 | Δ | ○ | Comp. |
| 309 | M-9 | II-5 | HUV-2 | 43 | 1.73 | 0.14 | Δ | x | Comp. |
| 310 | M-9 | VII-15 | HUV-2 | 44 | 1.72 | 0.16 | x | Δ | Comp. |
| 311 | M-9 | II-5 | UV-15 | 60 | 2.24 | 0.16 | ◎ | ◎ | Inv. |
| 312 | M-9 | VII-15 | UV-15 | 78 | 2.30 | 0.05 | ◎ | ◎ | Inv. |
| 313 | M-9 | DOP | UV-11 | 50 | 2.06 | 0.04 | ○ | Δ | Comp. |
| 314 | M-9 | TCP | UV-11 | 52 | 1.81 | 0.05 | ○ | x | Comp. |
| 315 | M-9 | * | UV-11 | 42 | 2.03 | 0.06 | ○ | Δ | Comp. |
| 316 | M-9 | II-5 | UV-11 | 75 | 2.26 | 0.05 | ○ | ○ | Inv. |
| 317 | M-9 | VII-5 | UV-11 | 76 | 2.25 | 0.04 | ○ | ○ | Inv. |
| 318 | M-9 | DOP | UV-24 | 55 | 1.99 | 0.05 | ○ | Δ | Comp. |
| 319 | M-9 | TCP | UV-24 | 52 | 1.75 | 0.03 | Δ | x | Comp. |
| 320 | M-9 | * | UV-24 | 45 | 1.98 | 0.07 | Δ | ○ | Comp. |
| 321 | M-9 | II-5 | UV-24 | 73 | 2.25 | 0.04 | ◎ | ◎ | Inv. |
| 322 | M-9 | VII-5 | UV-24 | 71 | 2.23 | 0.05 | ○ | ◎ | Inv. |
| 323 | M-9 | DOP | UV-25 | 53 | 2.04 | 0.06 | Δ | Δ | Comp. |
| 324 | M-9 | TCP | UV-25 | 52 | 1.87 | 0.04 | Δ | x | Comp. |
| 325 | M-9 | * | UV-25 | 44 | 2.05 | 0.06 | Δ | ○ | Comp. |
| 326 | M-9 | II-5 | UV-25 | 61 | 2.27 | 0.05 | ◎ | ○ | Inv. |
| 327 | M-9 | VII-5 | UV-25 | 62 | 2.24 | 0.04 | ◎ | ◎ | Inv. |

*Comparative HBS-1
Comp.: Comparison
Inv.: Invention

It is obvious from the results shown in Table 5 that when the liquid-type UV absorbent and the polyhydric alcohol according to the present invention are used in combination, improvements in the ratio of the residual dye, dye-forming efficiency, occurrence of stain and sweating. Further surprisingly, it is understood that there is also distinguishable improvement in the clearness of the dye image when the polyhydric alcohol and the liquid-type UV absorbent are used in combination.

Further, it is understood that the effects of the present invention can remarkably be exerted when the total process ing time from color development to drying is carried out within four minutes.

EXAMPLE 4

Sample Nos. 401 through 440 were prepared in the same manner as Sample No. 1 in Example 1, provided that in this example 1 mg/m$^2$ each of HBS and magenta dye-forming coupler as shown in Tables 8 were incorporated in the third layer and 2 mmol/m$^2$ and 1 mmol/m$^2$ of UV absorbent was incorporated in the fourth and the sixth layers, respectively.

TABLE 6

| Sample No. | Third Layer Magenta Coupler | Third Layer HBS | 4th and 6th Layers * | UV Absorbent | Ratio of Residual Dye | Dye-Forming Efficiency | ΔDb | Sweating | Clearness | Remarks |
|---|---|---|---|---|---|---|---|---|---|---|
| 401 | M-7 | DOP | 10 | UV-14 | 11 | 0.88 | 0.11 | ○ | x | Comp. |
| 402 | M-7 | DOP | 40 | UV-14 | 20 | 1.31 | 0.12 | ○ | x | Comp. |
| 403 | M-7 | DOP | 60 | UV-14 | 30 | 1.88 | 0.11 | ○ | x | Comp. |
| 404 | M-7 | DOP | 100 | UV-14 | 31 | 1.84 | 0.11 | ○ | Δ | Comp. |
| 405 | M-7 | DOP | 200 | UV-14 | 32 | 1.85 | 0.12 | ○ | Δ | Comp. |
| 406 | M-7 | II-5 | 10 | UV-14 | 27 | 1.31 | 0.03 | ◎ | ○ | Inv. |
| 407 | M-7 | II-5 | 40 | UV-14 | 35 | 1.52 | 0.04 | ◎ | ○ | Inv. |
| 408 | M-7 | II-5 | 60 | UV-14 | 58 | 2.11 | 0.03 | ◎ | ○ | Inv. |
| 409 | M-7 | II-5 | 100 | UV-14 | 60 | 2.11 | 0.05 | ◎ | ◎ | Inv. |
| 410 | M-7 | II-5 | 200 | UV-14 | 58 | 2.12 | 0.03 | ○ | ◎ | Inv. |
| 411 | M-7 | III-12 | 10 | UV-14 | 24 | 1.29 | 0.03 | ◎ | ○ | Inv. |
| 412 | M-7 | III-12 | 40 | UV-14 | 33 | 1.51 | 0.04 | ◎ | ○ | Inv. |
| 413 | M-7 | III-12 | 60 | UV-14 | 69 | 2.22 | 0.03 | ◎ | ○ | Inv. |
| 414 | M-7 | III-12 | 100 | UV-14 | 70 | 2.18 | 0.04 | ◎ | ◎ | Inv. |
| 415 | M-7 | III-12 | 200 | UV-14 | 70 | 2.19 | 0.03 | ○ | ◎ | Inv. |

TABLE 6-continued

| Sample No. | Third Layer Magenta Coupler | Third Layer HBS | 4th and 6th Layers UV * | 4th and 6th Layers Absorbent | Ratio of Residual Dye | Dye-Forming Efficiency | ΔDb | Sweating | Clearness | Remarks |
|---|---|---|---|---|---|---|---|---|---|---|
| 416 | M-7 | IV-2 | 10 | UV-14 | 21 | 1.11 | 0.04 | ◎ | ○ | Inv. |
| 417 | M-7 | IV-2 | 40 | UV-14 | 38 | 1.53 | 0.03 | ◎ | ○ | Inv. |
| 418 | M-7 | IV-2 | 60 | UV-14 | 71 | 2.11 | 0.05 | ◎ | ○ | Inv. |
| 419 | M-7 | IV-2 | 100 | UV-14 | 70 | 2.11 | 0.04 | ◎ | ◎ | Inv. |
| 420 | M-7 | IV-2 | 200 | UV-14 | 72 | 2.12 | 0.03 | ○ | ◎ | Inv. |
| 421 | M-7 | V-3 | 10 | UV-14 | 21 | 0.98 | 0.04 | ◎ | ○ | Inv. |
| 422 | M-7 | V-3 | 40 | UV-14 | 35 | 1.54 | 0.03 | ◎ | ○ | Inv. |
| 423 | M-7 | V-3 | 60 | UV-14 | 74 | 2.11 | 0.03 | ○ | ◎ | Inv. |
| 424 | M-7 | V-3 | 100 | UV-14 | 77 | 2.19 | 0.04 | ◎ | ◎ | Inv. |
| 425 | M-7 | V-3 | 200 | UV-14 | 76 | 2.21 | 0.03 | ○ | ◎ | Inv. |
| 426 | M-7 | VII-5 | 30 | UV-14 | 40 | 1.55 | 0.05 | ◎ | ○ | Inv. |
| 427 | M-7 | VII-5 | 70 | UV-14 | 69 | 2.21 | 0.04 | ◎ | ◎ | Inv. |
| 428 | M-7 | VII-5 | 200 | UV-14 | 70 | 2.19 | 0.03 | ○ | ◎ | Inv. |
| 429 | M-7 | VIII-12 | 30 | UV-14 | 40 | 1.54 | 0.04 | ◎ | ○ | Inv. |
| 430 | M-7 | VIII-12 | 70 | UV-14 | 66 | 2.19 | 0.03 | ◎ | ◎ | Inv. |
| 431 | M-7 | VIII-12 | 200 | UV-14 | 70 | 2.22 | 0.03 | ○ | ◎ | Inv. |
| 432 | M-7 | IX-4 | 30 | UV-14 | 41 | 1.55 | 0.04 | ◎ | ○ | Inv. |
| 433 | M-7 | IX-4 | 70 | UV-14 | 63 | 2.19 | 0.04 | ◎ | ◎ | Inv. |
| 434 | M-7 | IX-4 | 200 | UV-14 | 65 | 2.22 | 0.03 | ○ | ◎ | Inv. |
| 435 | M-7 | X-6 | 30 | UV-14 | 41 | 1.54 | 0.03 | ◎ | ○ | Inv. |
| 436 | M-7 | X-6 | 70 | UV-14 | 66 | 2.23 | 0.04 | ◎ | ◎ | Inv. |
| 437 | M-7 | X-6 | 200 | UV-14 | 67 | 2.22 | 0.05 | ○ | ◎ | Inv. |
| 438 | M-7 | XI-4 | 30 | UV-14 | 39 | 1.49 | 0.03 | ◎ | ○ | Inv. |
| 439 | M-7 | XI-4 | 70 | UV-14 | 66 | 2.11 | 0.04 | ◎ | ◎ | Inv. |
| 440 | M-7 | XI-4 | 200 | UV-14 | 65 | 2.22 | 0.03 | ○ | ◎ | Inv. |

Comp.: Comparison
Inv.: Invention
*) weight ratio of HBS to magenta dye-forming coupler: (weight of HBS/weight of magenta dye-forming coupler) × 100 (%)

As obvious from the results shown in Table 6, it is understood that effects of the present invention were not obtained when the polyhydric alcohol according to the present invention was made present at a proportion less than 50% by weight with respect to the dye-forming coupler and in contrast thereto, the effects of the present invention were remarkably displayed when the ratio is not less than 50% by weight.

What is claimed is:

1. A silver halide color photographic material comprising a support having thereon a light-sensitive silver halide emulsion layer and a nonlight-sensitive layer, wherein said nonlight-sensitive layer contains a UV absorbent having a melting point of 35° C. or less and said silver halide emulsion layer contains a polyhydric alcohol, wherein said polyhydric alcohol is a compound selected from the group consisting of:

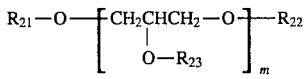

wherein $R_{21}$, $R_{22}$ and $R_{23}$ independently represent a hydrogen atom, an alkyl group, an alkenyl group, a cycloalkyl group, a cycloalkenyl group, an acyl group, a sulfonyl group, a phosphonyl group, a carbamoyl group, or a sulfamoyl group; m represents an integer from 1 to 20, provided that when m is 1, two of $R_{21}$, $R_{22}$ and $R_{23}$ are hydrogen atoms and the other is not a hydrogen atom, and that when m is 2 or more, at least two are hydrogen atoms and $R_2$, $R_{22}$ and $R_{23}$ are not all simultaneously hydrogen atoms;

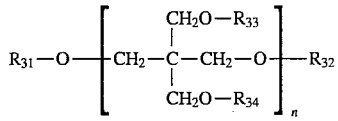

wherein $R_{31}$ through $R_{34}$ independently represent a hydrogen atom, an alkyl group, an alkenyl group, a cycloalkyl group, a cycloalkenyl group, an acyl group, a sulfonyl group, a phosphonyl group, a carbamoyl group or a sulfamoyl group; n represents an integer from 1 to 20, provided that when n is 1, at least two are hydrogen atoms and $R_{31}$, $R_{33}$ and $R_{34}$ are not all simultaneously hydrogen atoms, and that when n is 2 or more, at least two of $R_{31}$, $R_{32}$plural $R_{33}$'s and plural $R_{34}$'s are hydrogen atoms and $R_{31}$, $R_{32}$, $R_{33}$ and $R_{34}$ are not all simultaneously hydrogen atoms;

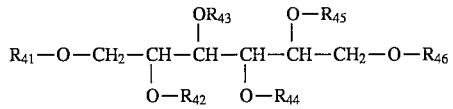

wherein $R_{41}$ through $R_{46}$ independently represent a hydrogen atom, an alkyl group, an alkenyl group, a cycloalkyl group, a cycloalkenyl group, an acyl group, a sulfonyl group, a phosphonyl group, a carbamoyl group or a sulfamoyl group, provided that at least two are hydrogen atoms and $R_{41}$ through $R_{46}$ are not all simultaneously hydrogen atoms;

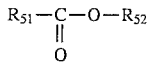

wherein $R_{51}$ represents an alkyl group or an alkenyl group, each of which contains two or more hydroxy groups; $R_{52}$ represents an alkyl group, an alkenyl group, a cycloalkyl group, or a cycloalkenyl group; or $R_{51}$ and $R_{52}$ are combined with each other to form a lactone ring;

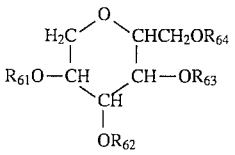

or

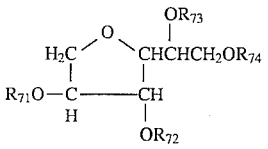

wherein $R_{61}$, $R_{62}$, $R_{63}$, $R_{64}$, $R_{71}$, $R_{72}$, $R_{73}$ and $R_{74}$, are hydrogen atoms and all of them are not simultaneously hydrogen atoms; and

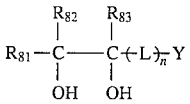

wherein $R_{81}$, $R_{82}$ and $R_{83}$ independently represent a hydrogen atom, an alkyl group, an alkenyl group, a cycloalkyl group, a cycloalkenyl group, an aryl group or a carbamoyl group; L represents an alkene group or an arylene group; Y represents a hydrogen atom, a carbamoyl group, a sulfamoyl group or an acyl group and n represents 0 or 1.

2. The silver halide photographic material of claim 1, further comprising a coupler in a ratio of said polyhydric alcohol to the coupler of 0.5 to 5 based on the weight.

3. The silver halide photographic material of claim 2, further comprising a high boiling-point solvent.

4. The silver halide photographic material of claim 1, wherein said silver halide emulsion layer contains a coupler represented by the following formula M-I, Formula M-I

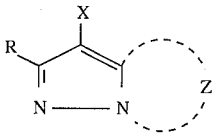

wherein Z represents a group of non-metal atoms necessary for forming a nitrogen-containing heterocyclic ring; X represents a hydrogen atom or a group capable of being released upon coupling reaction with an oxidation product of a color developing agent and R represents a hydrogen atom or a substituent.

5. The silver halide photographic material of claim 1, wherein said silver halide emulsion layer contains silver halide grains having a chloride content of 95 to 99.5 mol %.

* * * * *

UNITED STATES PATENT AND TRADEMARK OFFICE

CERTIFICATE OF CORRECTION

PATENT NO. : 5,576,161

DATED : November 19, 1996

INVENTOR(S) : Motoi NISHIMURA et al.

It is certified that error appears in the above-indentified patent and that said Letters Patent is hereby corrected as shown below:

Claim 1, column 65, line 66, "$R_2$" should read --$R_{21}$--.

Claim 1, column 66, line 51, "$R_{32}$plural" should read --$R_{32}$, plural--.

Claim 1, column 67, line 27, "$R_{74}$," should read --$R_{74}$--.

Signed and Sealed this

Twenty-ninth Day of April, 1997

Bruce Lehman

*Attest:*

BRUCE LEHMAN

*Attesting Officer*

*Commissioner of Patents and Trademarks*